US005355862A

United States Patent [19]

Muramatsu et al.

[11] Patent Number: 5,355,862

[45] Date of Patent: Oct. 18, 1994

[54] EVAPORATED FUEL CONTROL SYSTEM IN INTERNAL COMBUSTION ENGINE

[75] Inventors: Hiroaki Muramatsu; Shinichi Kitajima; Hiroshi Kitagawa; Teruo Wakashiro; Toshikatsu Takanohashi, all of Wako; Yoshihiko Kobayashi, Tochigi; Hiroshi Maruyama, Wako, all of Japan

[73] Assignee: Honda Giken Kogyo Kabushiki Kaisha, Tokyo, Japan

[21] Appl. No.: 38,093

[22] Filed: Mar. 30, 1993

[30] Foreign Application Priority Data

Mar. 31, 1992 [JP] Japan ..... 4-105535
Jan. 29, 1993 [JP] Japan ..... 5-013457

[51] Int. Cl.[5] ..... F02M 25/08
[52] U.S. Cl. ..... 123/520
[58] Field of Search ..... 123/516, 518, 519, 520, 123/521

[56] References Cited

U.S. PATENT DOCUMENTS 4,763,634 8/1988 Morozumi ..... 123/520
4,821,701 4/1989 Nankee, II et al. ..... 123/520
5,044,341 9/1991 Henning et al. ..... 123/520
5,048,492 9/1991 Davenport et al. ..... 123/520
5,060,621 10/1991 Cook et al. ..... 123/520
5,090,388 2/1992 Hamburg et al. ..... 123/520
5,195,495 3/1993 Kitamoto et al. ..... 123/518
5,215,055 6/1993 Orzel ..... 123/520
5,224,456 7/1993 Hosuda et al. ..... 123/520

FOREIGN PATENT DOCUMENTS 62-26362 2/1987 Japan .

*Primary Examiner*—E. Rollins Cross
*Assistant Examiner*—Thomas N. Moulis
*Attorney, Agent, or Firm*—Nikaido, Marmelstein, Murray & Oram

[57] ABSTRACT

An evaporated fuel control system in internal combustion engines includes a canister filled with an adsorbent for adsorbing an evaporated fuel in a fuel tank, a purge amount control device provided in the middle of a purge passage connecting an intake passage and the canister, and a fuel supply device. The purge flow rate from the start of purging is integrated, and the purge amount is reduced to a larger extent in response to a purge amount integration value becoming smaller. This improves the nature of an exhaust gas immediately after the start of purging and the like.

4 Claims, 20 Drawing Sheets

START
S11
ME OVERFLOW?
YES
NO
S12
STARTING MODE?
YES
NO
S13
RESETTING OF TIMER (ts)
S16
ts LAPSED?
NO
YES
S14
FI ←0
S17
FI=1?
YES
NO
S15
READING OF TA, TW
S18
SEARCHING OF
TW REGION BY TA
S19
TW<TWENVH?
NO
YES
S20
TW>TWENVL?
NO
YES
S21
QPAIRT ←BACKUP VALUE
S22
BACKING-UP OF QPAIRT
QPAIRT ←0
S23
FI ←1
END

START
S24
SEARCHING OF KHC CORRESPONDING TO QPAIRT
S25
CURRENT FF =1?
YES
NO
S26
KPFDI ← INITIAL VALUE
S28
NO
LAST FF=1?
YES
S29
KPFDI ← INITIAL VALUE
S31
SEARCHING OF DKPFDI CORRESPONDING TO NE
S27
KPG ← KHC
S32
KPFDI ← KPFDI +DKPFDI
S33
NO
KPFDI ≧ 1?
YES
S34
KPFDI ← 1
S30
KPG ← KHC × KPFDI
END

START
S50
FE=1?
YES
NO
S51
IN FEEDBACK OPERATION OF O2?
NO
YES
S53
Tw>Two?
NO
YES
S54
FI=1?
NO
YES
S55
FF=1?
NO
YES
S52
SETTING OF TIMER (tm)
S56
SETTING OF TIMER (tm)
1
S57
tm LAPSED?
NO
YES
S58
JET PURGING?
NO
YES
3
2
END

START
S97
FR=1?
YES
S111
Fc←1
S98
θ TH≦ θ THI?
YES
S99
NO
S106
SEARCHING OF PBPCT
SEARCHING OF NEPCT
S100
YES
PBA≧PBPCT?
S107
NE>NEPCT?
NO
NO
S101
NE ≦NPBPCLMT?
NO
YES
YES
S102
KLS<1.0?
YES
S103
NO
S108
Fc ←0
Fc ←1
S104
SETTING OF TIMER (tc)
S109
NO
tc=0?
S105
S110
YES
UNESTABLISHMENT OF FUEL-CUT
ESTABLISHMENT OF FUEL-CUT
END

| | PBG 1 | PBG 2 | ..... | PBG 6 |
|---|---|---|---|---|
| QPAIR1 | Duty 1.1 | Duty 2.1 | ..... | Duty 6.1 |
| QPAIR2 | | | | |
| QPAIR3 | | | | |
| QPAIR4 | | | | |
| QPAIR5 | | | | |
| QPAIR6 | | | | |
| QPAIR7 | | | | |
| QPAIR8 | Duty 1.8 | Duty 2.8 | ..... | Duty 6.8 |

EVAPORATED FUEL CONTROL SYSTEM IN INTERNAL COMBUSTION ENGINE

BACKGROUND OF THE INVENTION

1. Field of the Invention

The present invention relates to an evaporated fuel control system in an internal combustion engine, which has a canister filled with an adsorbent for adsorbing an evaporated fuel in a fuel tank, a purge amount control means provided in a middle of a purge passage connecting an intake passage and the canister, and a fuel supply means.

2. Description of the Prior Art

An evaporated fuel control system is conventionally broadly known which prevents evaporated fuel generated in a fuel tank from being released into the atmosphere during stoppage of an engine. The system of such a type is designed such that evaporated fuel from the fuel tank is adsorbed by an adsorbent in the canister during the stoppage of the engine, and the evaporated fuel adsorbed by the adsorbent is released or purged into an intake system, for example, as disclosed in Japanese Patent Application,Laid-open No. 26362/87.

In the above prior art system, a duty control valve is provided in the purge passage between the canister and the intake passage and its duty ratio is gradually increased when it is shifted from 0% to 100%, thereby reducing the variation in air-fuel ratio during shifting from a non-purging condition to a full purging condition, thus providing an improvement in the nature of an exhaust gas.

Immediately after the start of purging, however, the evaporated fuel, that may be purged from the canister into the intake passage, shows a tendency in many cases that contains hydrocarbon in a higher concentration as the purge amount integration value is reduced. In such a case, particularly at a low temperature at which a catalyst in an exhaust system is not in an activated condition, the hydrocarbon may exert an adverse influence on the nature of the exhaust gas in some cases. No consideration has been given to this respect in the above prior art control system. Therefore, the prior art does not assure a sufficient improvement in the nature of the exhaust gas.

SUMMARY OF THE INVENTION

Accordingly, it is an object of the present invention to provide an evaporated fuel control system in an internal combustion engine, wherein the nature of an exhaust gas immediately after the start of purging can be improved.

To achieve the above object, according to a first aspect and feature of the present invention, there is provided an evaporated fuel control system in an internal combustion engine, comprising a canister filled with an adsorbent for adsorbing evaporated fuel in a fuel tank, a purge amount control means provided in a middle of a purge passage connecting an intake passage and the canister, and a fuel supply means, wherein the system further includes an electronic control unit for integrating the purge flow rate from the start of purging and for controlling the operation of the purge amount control means so as to reduce the purge amount to a larger extent in response to the integrated purge amount value becoming smaller.

With the above construction, the purge flow rate from the start of purging is integrated, and the purge amount is reduced to a larger extent in response to the purge amount integration value becoming smaller. Therefore, when the concentration of the evaporated fuel purged is high immediately after the start of purging, the purge flow rate is largely reduced, thereby enabling a purge flow rate control in correspondence to the purge concentration, thus preventing any deterioration in the nature of the exhaust gas.

According to a second aspect and feature of the present invention in addition to the first feature, the electronic control unit sets an initial value for integrating the purge amount, in a new operation, to a final value of the purge amount integration values integrated during the last operation of the engine, when the engine, during starting thereof, is in such an operational state that the engine is at a predetermined temperature and is now being restarted.

With the above second feature of the present invention, when the engine, during starting thereof, is in such an operational state that it at a predetermined temperature and is being restarted, the initial value in the integration of the purge amount is set at the final value of the purge amount integration values integrated during the last operation of the engine. Therefore, it is possible to perform a purge amount control in accordance with the amount of evaporated fuel stored in the canister and to start the integration of the purge amount in consideration of the amount of evaporated fuel stored in the canister during the starting of the engine, thereby enabling a proper control of air-fuel ratio.

Further, according to a third aspect and feature of the present invention in addition to the first or second feature, the electronic control unit controls the operation of the fuel supply means, such that the amount of fuel supplied is increased as an air-fuel ratio correction value, corresponding to the concentration of oxygen in the exhaust gas, is increased. The electronic control unit prohibits the integration of the purge amount and determines the purge amount in accordance with the purge amount integration value obtained immediately before the prohibition, when the air-fuel ratio correction value is less than a predetermined value.

With the above third feature of the present invention, the operation of the fuel supply means is controlled, such that the amount of fuel supplied is increased as the air-fuel ratio correction value, corresponding to the concentration of oxygen in the exhaust gas, is increased. When the air-fuel ratio correction value is less than a predetermined value, the integration of the purge amount is prohibited and the purge amount is determined in accordance with the purge amount integration value obtained immediately before the prohibition. Therefore, it is possible to control the purge amount in accordance with the amount of evaporated fuel stored in the canister, and to prevent an increase in error between the amount of evaporated fuel actually stored in the canister and the amount of evaporated fuel evaluated based on the purge amount integration value, thereby preventing purge control based on the purge amount integration value from exerting an adverse influence on the control of the air-fuel ratio.

According to a fourth aspect and feature of the present invention, in addition to the third feature, the electronic control unit reduces the purge integration amount by a predetermined amount at every control cycle and determines the purge amount in accordance with the reduced purge amount integration value, when a condition, in which the air-fuel ratio correction value is a lower limit value, is continued for a predetermined time.

With the above fourth feature of the present invention, when the condition, in which the air-fuel ratio correction value is the lower limit value, is continued for the predetermined time, the purge integration amount is reduced by the predetermined amount at every control cycle, and the purge amount is determined in accordance with the reduced purge amount integration value. Therefore, it is possible to correct the error or deviation between the amount of evaporated fuel actually stored in the canister and the amount of evaporated fuel evaluated based on the purge amount integration value, thereby further reducing any adverse influence exerted by the purge control on the control of the air-fuel ratio.

The above and other objects, features and advantages of the invention will become apparent from the following description of the preferred embodiment, taken in conjunction with the accompanying drawings.

DESCRIPTION OF THE PREFERRED EMBODIMENTS

The present invention will now be described by way of a preferred embodiment in connection with the accompanying drawings.

Figure 1:
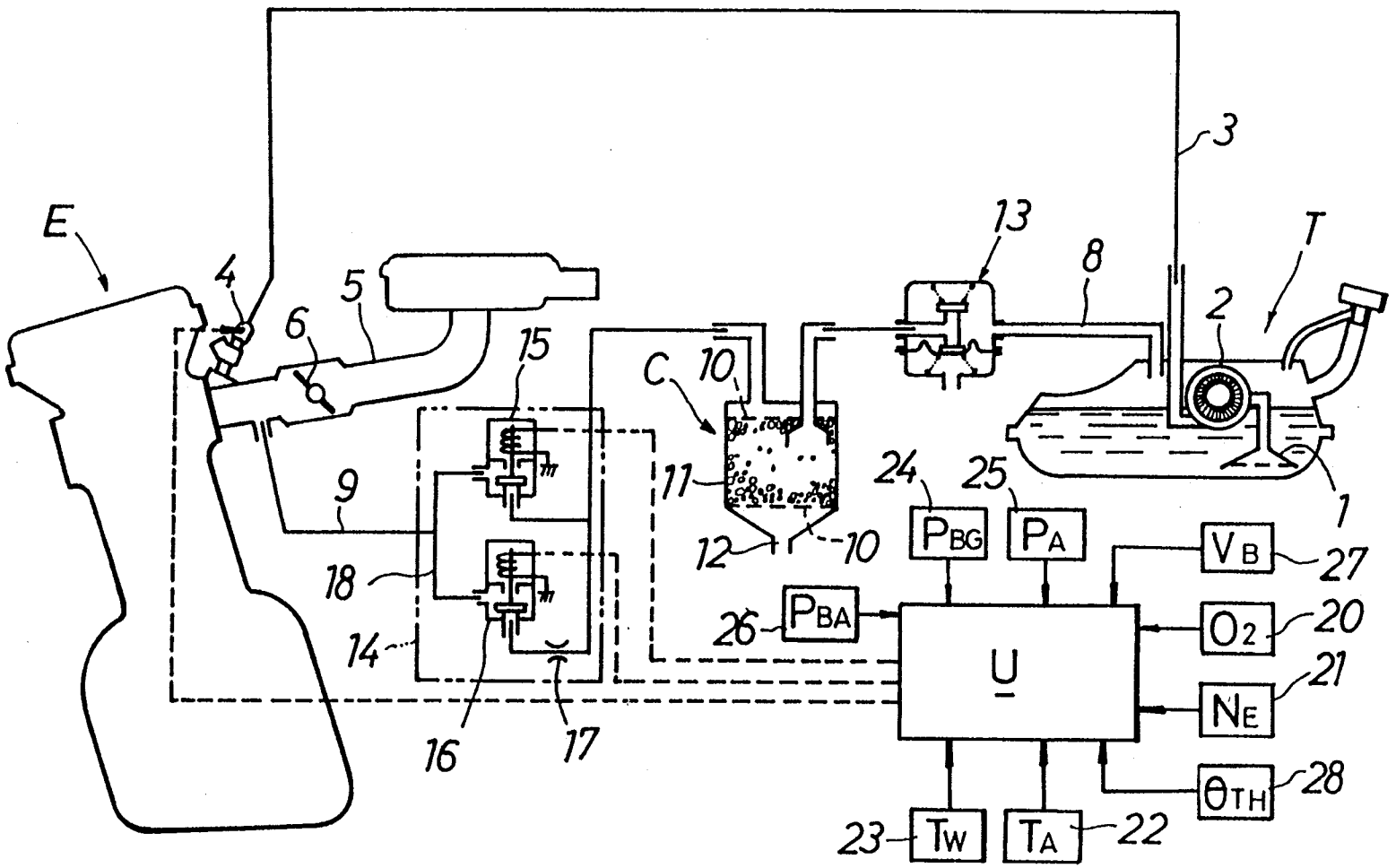
FIG. 1 is an illustration of the entire construction of an evaporated fuel purge control system according to a preferred embodiment of the present invention.

Referring first to FIG. 1, a fuel is pumped from a fuel tank T through a filter 1 and fuel pump 2 and is supplied through a fuel supply passage 3 to a fuel injection valve 4 as a fuel supply means provided in an internal combustion engine E. A charge passage 8 is connected to an upper space within the fuel tank T and also through a canister C to a purge passage 9 which is connected to that portion of an intake passage 5 in the engine E which is downstream of a throttle valve 6.

The canister C is of an open bottom type with its lower end opened. The canister C comprises a pair of upper and lower filters 10, 10, and an activated carbon 11 serving as an adsorbent accommodated between the filters 10, 10. The charge passage 8 on the side of the fuel tank T is opened into the activated carbon 11, and the purge passage 9 on the side of the internal combustion engine E is opened into a space above the upper filter 10. A space below the lower filter 10 is opened to the atmosphere through an atmosphere opening passage 12.

A two-way valve 13 is provided in the middle of the charge passage 8. The valve 13 is opened when the internal pressure in the fuel tank T is increased to exceed the atmospheric pressure by a predetermined value and when the internal pressure in the fuel tank T is reduced to a level lower than the internal pressure in the canister C by a predetermined value, thereby providing the communication between the fuel tank T and the canister C. When evaporated fuel from the canister C is purged into the intake passage 5, the charge passage 8 at the side of the canister C may be depressurized to a negative pressure in some cases, but in such a case, the two-way valve 13 is maintained closed.

A purge amount control means 14 is provided in the middle of the purge passage 9. This control means 14 comprises a duty control valve 15 whose opening degree can be varied as desired by a linear solenoid which is duty-controlled; and an on/off control valve 16 as well as a jet orifice 17 provided in series in a bypass passage 18 bypassing the duty control valve 15.

It is difficult for the duty control valve 15 to control the small flow rate, for example, with a duty rate of 5% or less. If a control is performed to reduce the amount of evaporated fuel purged only by the duty control valve 15, for example, during idling with a small load on the engine, the purge flow rate become unstable, so that the air-fuel ratio is varied to bring about a deteriorated nature of an exhaust gas, but also to frequently generate an operational sound with the opening and closing operation of the duty control valve 15. Thereupon, the on/-off control valve 16 and the jet orifice 17, which are connected in series, are connected in parallel to the duty control valve 15, thereby enabling a stabilized control of the low flow rate without any deterioration of the air-fuel ratio and avoiding the frequent generation of the operational sound.

The fuel injection valve 4, and the duty control valve 15 as well as the on/off control valve 16 in the purge amount control means 14 are controlled by an electronic control unit U comprising a microcomputer. Connected to the electronic control unit U are an oxygen concentration sensor 20 for detecting the concentration of oxygen $O_2$ in an exhaust gas from the internal combustion engine, a revolution number sensor 21 for detecting the number $N_E$ of revolution of the internal combustion engine E, an intake gas temperature sensor 22 for detecting the temperature $T_A$ of an intake gas into the internal combustion engine E, a water temperature sensor 23 for detecting the temperature $T_W$ of cooling water for the internal combustion engine E, a first intake pressure sensor 24 for detecting the intake pressure $P_{BG}$ in the intake passage 5 downstream of the throttle valve 6 by means of a gauge pressure, an atmospheric pressure sensor 25 for detecting the atmospheric pressure $P_A$, a second intake pressure sensor 26 for detecting the intake pressure $P_{BA}$ in the intake passage 5 downstream of the throttle valve 6 by means of an absolute pressure, a battery voltage sensor 27 for detecting the voltage $V_B$ of a battery for driving the duty control valve 15 and the on/off control valve 16, and a throttle opening degree sensor 28 for detecting the opening degree $\Theta_{TH}$ of the throttle valve 6.

The electronic control unit U comprises an input circuit for adjusting the waveform of an input signal from each of the sensors 20 to 28 to correct the voltage level to a predetermined voltage level and to convert it into an analog signal value and so on. The control unit U also comprises a central processing circuit; a storage means for storing a calculating program carried out in the central processing circuit and for storing the result of such a calculation; and an output circuit which delivers a driving signal to the fuel injection valve 4, the duty control valve 15 and the on/off control valve Thus, the electronic control unit U calculates the signals from the sensors 20 to 28 according to a previously established program, and performs a feed-back control or an open control at the time of injection of the fuel from the fuel injection valve 4, and a control of the opening and closing operations of the duty control valve 15 and the on/off control valve 16.

When the engine E is stopped, the duty control valve 15 and the on/off control valve 16 are in their closed states. If the temperature within the fuel tank T is rises in this condition, resulting in an increased internal pressure, the two-way valve 13 is opened, thereby permitting a fuel vapor within the fuel tank T to flow through the charge passage 8 into the canister C, where it is adsorbed to the activated carbon 11. In this manner, the fuel vapor is prevented from being leaked to the outside. Moreover, the increased internal pressure in the fuel tank T escapes through the atmosphere opening passage 12 in the canister C to the outside. Thus, the internal pressure in the fuel tank T is prevented from being increased excessively. If the internal pressure in the fuel tank T is reduced as the temperature is lowered when the engine E is stopped, then the open air is introduced into the fuel tank T via a path reverse from the above-described path, thereby preventing the internal pressure in the fuel tank T from being reduced.

If the purge passage 9 is opened by the purge amount control means 14 after the start of the internal combustion engine E, air introduced through the atmosphere opening passage 12 in the canister C, in response to the negative pressure in the intake passage 5, is drawn into the intake passage 5, and the fuel adsorbed to the activated carbon 11 in the canister C is purged, together with the air, into the intake passage 5.

A procedure for controlling the opening and closing of the duty control valve 15 and the on/off control valve 16 will be described below with reference to FIGS. 2 to 24.

First, in a main routine shown in FIG. 2, the following steps are sequentially carried out at first to sixth steps S1 to S6 according to a subroutine which will be described hereinafter: the initialization of a purge amount integration value QPAIRT; the calculation of a purge correcting factor $K_{PG}$; the calculation of a target purge amount QPOBJ permitted by the duty control valve 15 and the on/off control valve 16 as well as a target purge amount QPOBJJET permitted by the on/-off control valve 16; the calculation of a purge amount QPAIR; the calculation of a purge integration valve QPAIRT; and the determination of a purge control mode. At a seventh step S7, it is determined whether or not the control of the purge amount is permitted by the duty control valve 15, i.e., whether or not the duty control of the duty control valve 15 should be carried out. If ,it is decided that the control should be carried out, a duty ratio DUTY is calculated at an eighth step S8 and then delivered at a tenth step S10. If it is decided that the control should not be carried out, the duty ratio DUTY is set at 0% (i.e., the duty control valve 15 is closed) at a ninth step S9, progressing continues to step S10.

Figure 2:
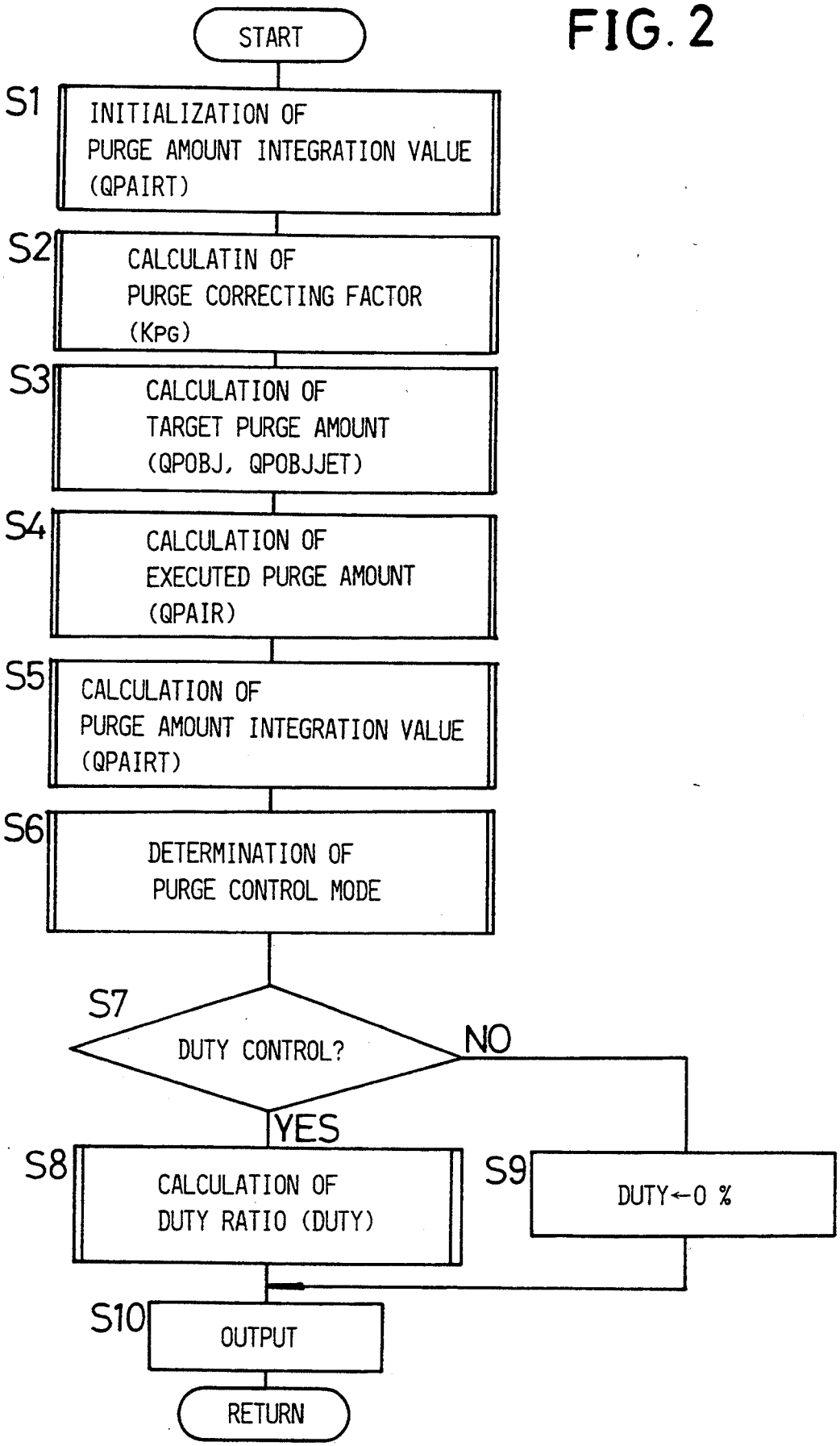
FIG. 2 is a flow chart illustrating a main routine of a purge control.
Figure 3:
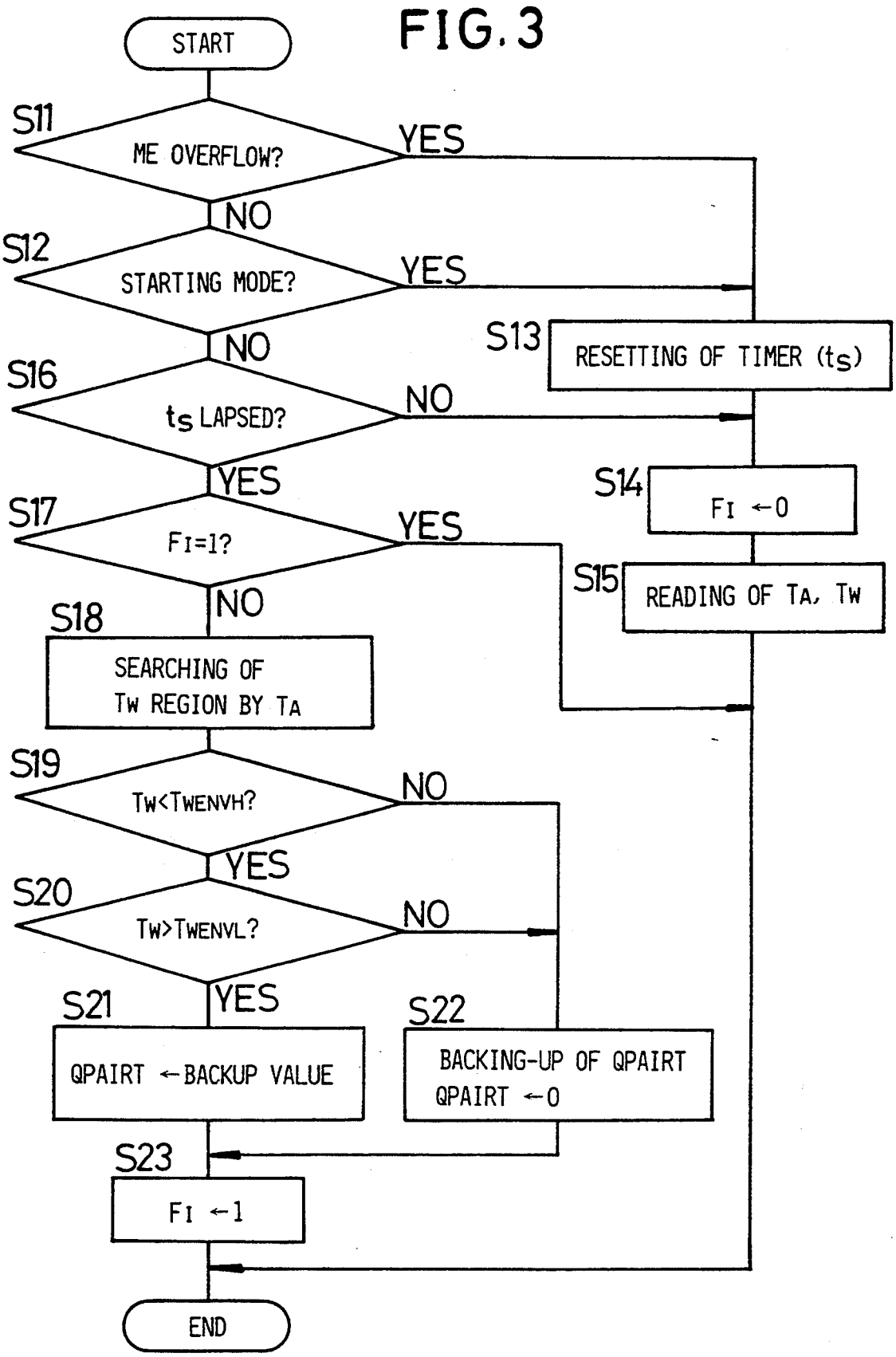
FIG. 3 is a flow chart illustrating a subroutine for initialization of a purge amount integration value.

FIG. 3 shows a subroutine for carrying out the initialization of the purge amount integration value QPAIRT in the main routine shown in FIG. 2. If it is detected at an 11th step S11 in the subroutine that ME ($=1/N_E$) is overflowing, i.e., that the engine E is stopped, or it is decided at a 12th step S12 that the engine E is in a starting mode, a timer for insuring a time required for determination of an initialization region is reset at a 13th step S13 and then, a flag $F_I$ is set at "0" at a 14th step S14. This flag $F_I$ indicates whether or not the determination of the initialization region has been completed. $F_I=1$ indicates that the determination of the initialization region has been completed, and $F=0$ indicates that the determination of the initialization region is not yet completed. At a next 15th step S15, the intake gas temperature $T_A$ and the cooling water temperature $T_W$ are read.

Figure 4:
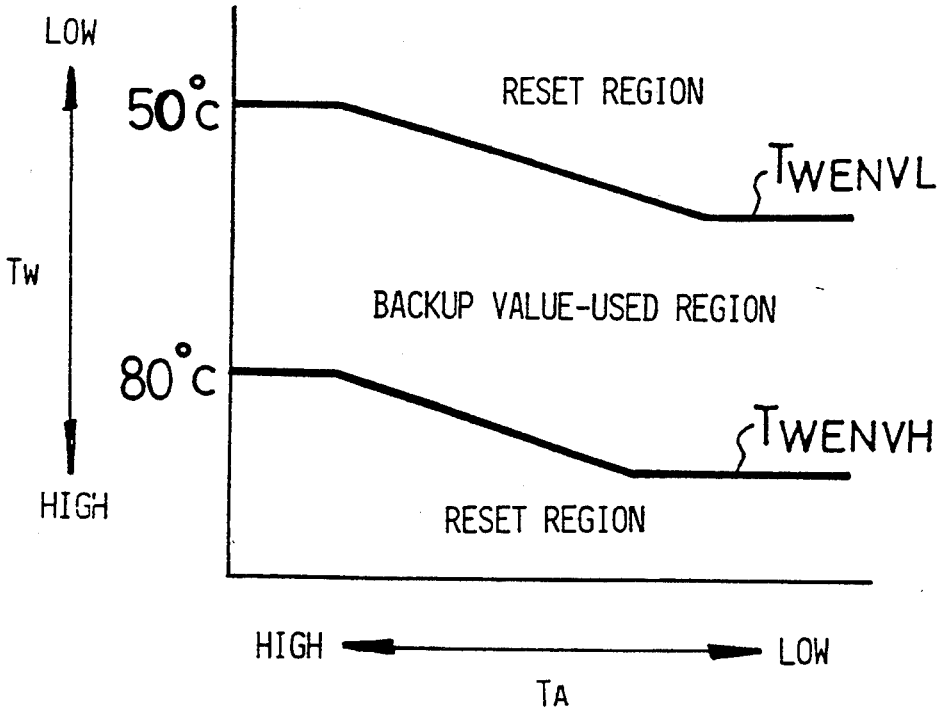
FIG. 4 is a map for determination of an initialization region in integrating the purge amount.

If it is decided at steps S11 and S12 that the engine E is not stopped and not in the starting mode, the processing is advanced to a 16th step S16. There, it is determined whether or not a preset time $t_s$ e.g., 5 seconds in the timer, reset at the step S13, has lapsed. If the preset time $t_s$ has not lapsed, the processing is advanced to step S14. If the preset time $t_s$ has lapsed, the processing is advanced to a 17th step S17. It is determined at step S17 whether or not $F_I=1$, i.e., whether or not the determination of the initialization region has been completed. If $F_I=0$, the processing is advanced to an 18th step S18, where a region of the cooling water temperature $T_W$, corresponding to the intake gas temperature $T_A$, is searched from a map previously established as shown in FIG. 4. Two conditions, a higher preset water temperature $T_{WENVH}$ decreased to a minimum 80° C. and a lower preset water temperature $T_{WENVL}$ decreased to a minimum 50° C. both with rising of the intake gas temperature $T_A$, have been previously established. If it is decided at the 19th and 20th steps S19 and S20 that $T_{WENVL}<T_W<T_{WENVH}$, the processing is advanced to a 21th step S21. If it is decided that $T_{WENVH}\leqq T_W\leqq T_{WENVL}$, the processing is advanced to a 22th step S22.

At the step S21, an initial value of the purge amount integration values QPAIRT is set as a backup value which has been stored so far. At the step S22, the initial value of the purge amount integration values QPAIRT is reset at "0", and the purge amount integration values QPAIRT so far are stored. After passage through the steps S21 and S22, the flag $F_I$ is set at "1" at a 23th step S23.

The subroutine shown in FIG. 3 is established so that the integration of the purge amount is started using, as an initial value, a final value of the purge amount integration values QPAIRT integrated till the engine E is stopped. If a region determined on the basis of the intake gas temperature $T_A$ and the cooling water temperature $T_W$ is a region for the backup value (i.e., if it is assumed that the engine E has been restarred for a short time), based on the supposition that the amount of evaporated fuel stored in the canister C is not varied at all most from the time when the engine E has been stopped, and only a short time has lapsed after the engine E has stopped, and based on the intake gas temperature $T_A$ and the cooling water temperature $T_W$, a determination can be made that the engine E is in a restarted state in which it is at a predetermined temperature. This makes it possible to integrate the purge amount integration value QPAIRT as a value substantially corresponding to an amount of evaporated fuel actually stored in the canister C.

Figure 5:
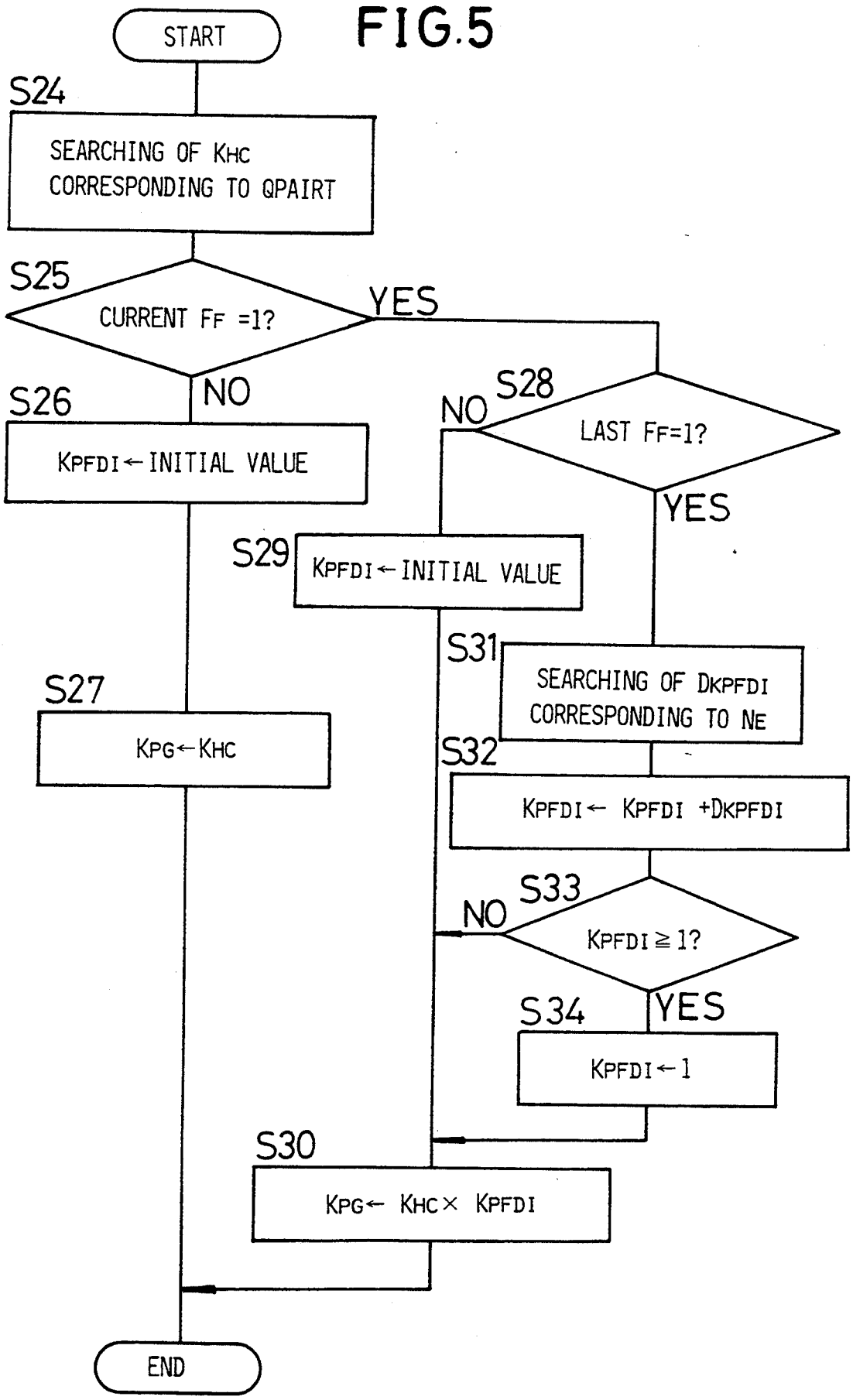
FIG. 5 is a flow chart illustrating a subroutine for calculating a purge correcting factor.
Figure 6:
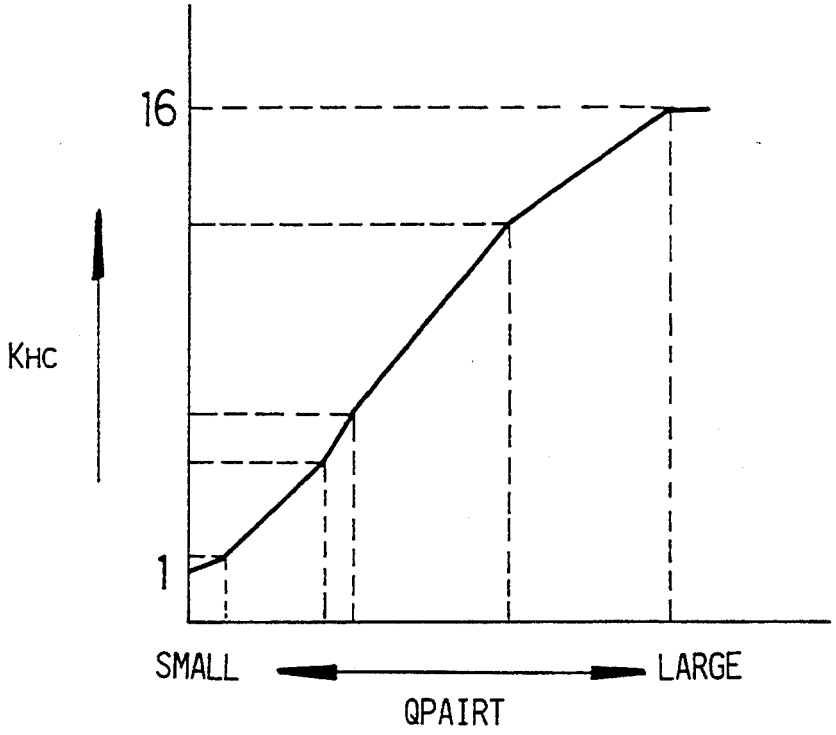
FIG. 6 is a map from which a factor, corresponding to the purge amount integration value, is searched.

FIG. 5 shows a subroutine for carrying out the calculation (at a second step S2) of a purge correcting factor $K_{PG}$ in the main routine shown in FIG. 2. At a 24th step S24 in this subroutine, a factor $K_{HC}$ corresponding to the purge amount integration value QPAIRT is searched. More specifically, a map with the factor $K_{HC}$ previously established therein in accordance with the purge amount integration value QPAIRT is prepared, and the factor $K_{HC}$ is searched from the map.

At a next 25th step S25, it is determined whether or not a current flag $F_F$ is equal to "1". This flag $F_F$ indicates whether or not the duty control of the duty control valve 15 should be carried out. $F_F=1$ indicates that the duty control should be carried out, and $F_F=0$ indicates that the duty control valve 15 should be maintained in its closed state. If the current flag $F_F$ is equal to "0", and the duty control of the duty control valve 15 should not be carried out, a gradually incorporating factor $K_{PFDI}$ is set at "1" which is an initial value at a 26th step S26 and then, a relation $K_{PG}=K_{HC}$ is established at a 27th step S27.

If it is decided at step S25 that $F_F=1$, i.e., in a condition in which the duty control of the duty control valve 15 is carried out, it is determined at a 28th step S28 whether or not the last time flag $F_F$ has been equal to "1", i.e., whether or not now is a time of switchover of the duty control valve 15 from its closed state to the duty control state. If now is the time of switchover of the duty control valve 15 from its closed state to the duty control state, the gradually incorporating factor $K_{PFDI}$ is set at the initial value at a 29th step S29, and a relation $K_{PG}=K_{HC}\times K_{PFDI}$ is established at a 30th step S30.

Figure 7:
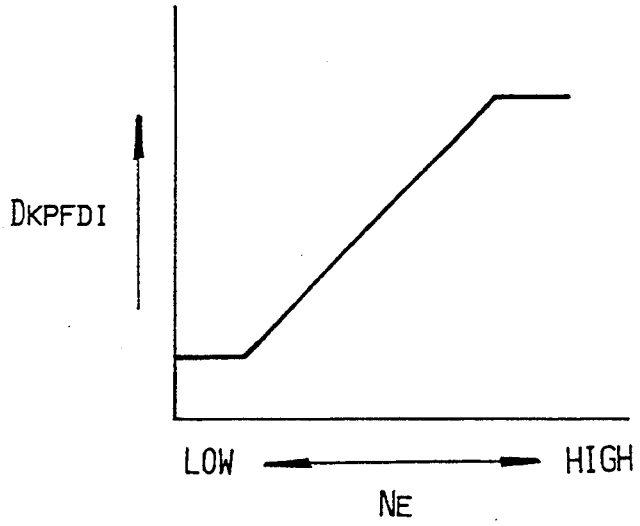
FIG. 7 is a map from which a correction value, corresponding to the number of revolution of an engine, is searched.

If it is decided at the step S28 that the last time flag $F_F$ has been also equal to "1", the processing is advanced to a 31th step S31, where a correcting value $D_{KPFDI}$ is searched from a map in which the correcting value $D_{KPFDI}$ has been set therein, so that it is increased as the number $N_E$ of revolutions of the engine is increased, as shown in FIG. 7. At a next 32th step S32, the correction value $D_{KPFDI}$ is added to the last gradually incorporating factor $K_{PFDI}$ to correct the gradually incorporating factor $K_{PFDI}$. If it is decided at a 33th step S33 that $K_{PFDI}<1$, the processing is advanced to the step S30. On the other hand, if it is decided that $K_{PFDI}\geqq 1$, a relation $K_{PFDI}=1$ is established, progressing to step S30.

In such a subroutine as shown in FIG. 5, when the duty control of the duty control valve 15 is not being carried out, the factor $K_{HC}$, which is set at a smaller value when the purge amount integration value QPAIRT is larger and which is set at a larger value when the purge amount integration value QPAIRT is smaller, is determined as a purge correcting factor $K_{PG}$. At the switchover of the duty control valve 15 from its closed state to the duty control state, a value resulting from the addition of the correcting value $D_{KPFDI}$, determined by the number $N_E$ of revolutions of the engine, to the last gradually incorporating factor $K_{PFDI}$ is determined as a new gradually incorporating factor $K_{PFDI}$, and a value resulting from the multiplication of the factor $K_{HC}$, by such a new gradually incorporating factor $K_{PFDI}$, is determined as a purge correcting factor $K_{PG}$.

Figure 8:
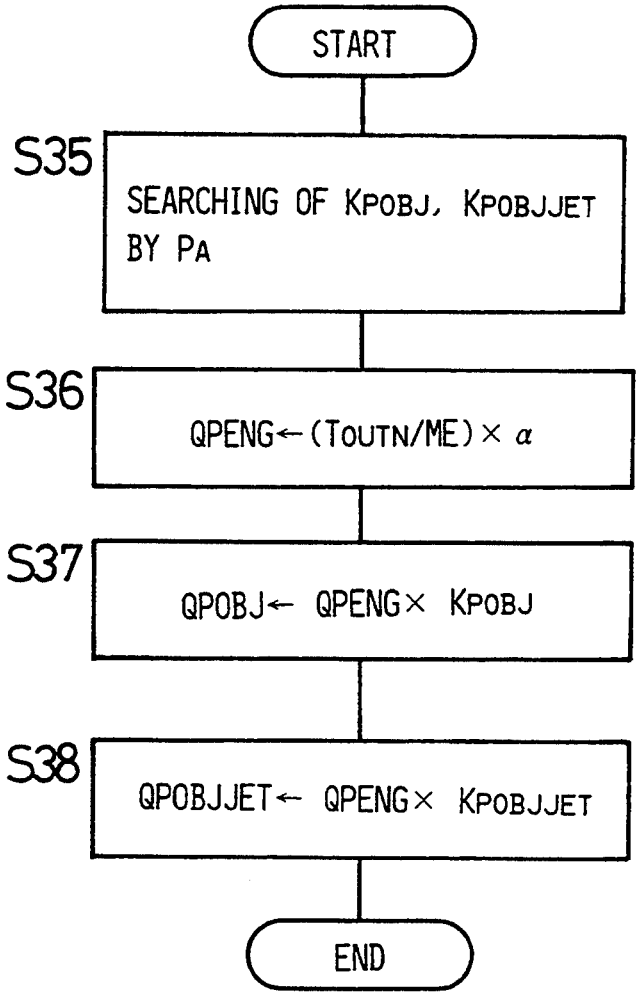
FIG. 8 is a flow chart illustrating a subroutine for calculating a target purge amount.
Figure 9:
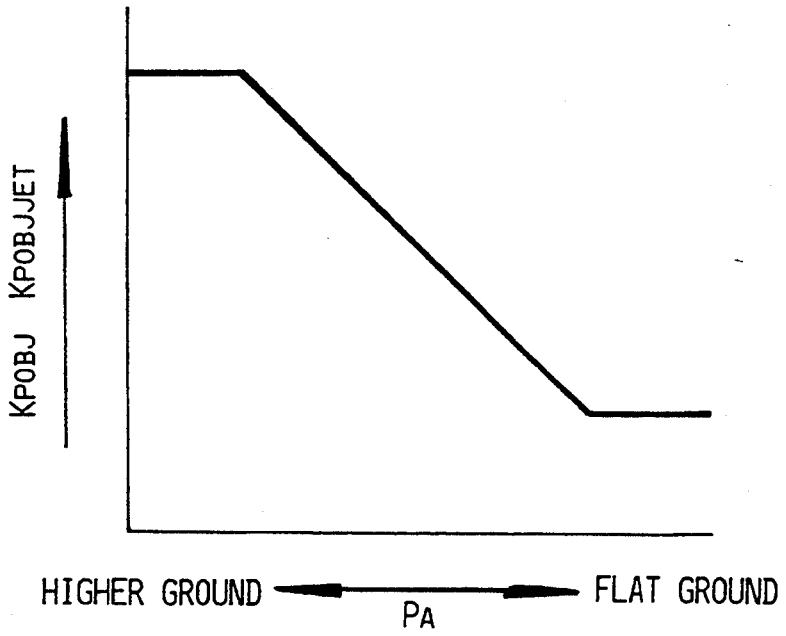
FIG. 9 is a map from which a correcting factor, corresponding to the atmospheric pressure, is searched.

FIG. 8 shows a subroutine for carrying out the calculation (the third step S3 in the main routine shown in FIG. 2) of the target purge amount QPOBJ permitted by the duty control valve 15 and the on/off control valve 16, as well as the target purge amount QPOBJJET at the time when the purging is carried out by use of only the on/off control valve 16. At a 35th step S35 in this subroutine, the searching of the correcting factors $K_{POBJ}$ and $K_{POBJJET}$ based on the atmospheric pressure $P_A$ is carried out. More specifically, as shown in FIG. 9, the correcting factors $K_{POBJ}$ and $K_{POBJJET}$ have previously been set in a map in accordance with the atmospheric pressure $P_A$, and the correcting factors $K_{POBJ}$ and $K_{POBJJET}$ have been set in this map, so that they are on the order of 10% on a flat ground (sea level).

At a 36th step S36, a reduced value QPENG of the amount of fuel injected from the fuel injection valve 4 into an amount corresponding to the evaporated fuel is calculated. In other words, if the time of injection of the fuel from the fuel injection valve 4 is represented by $T_{OUTN}$, and a constant factor is represented by $\alpha$, $QPENG=(T_{OUTN}/M_E)\times\alpha$. At a next 37th step S37, the target purge amount QPOBJ is calculated according to an expression, $QPOBJ=QPENG\times K_{POBJ}$, and further at a 38th step S38, the target purge amount QPOBJJET is calculated according to an expression, $QPOBJJET=QPENG\times K_{POBJJET}$.

In this subroutine shown in FIG. 8, a value resulting from convertion of the amount of fuel injected from the fuel injection valve 4 into the amount corresponding to the evaporated fuel, is corrected by the correcting factors $K_{POBJ}$ and $K_{POBJJET}$ (about 10% on flat ground) based on the atmospheric pressure $P_A$, and is determined as target purge amounts QPOBJ and QPOBJJET. More specifically, on the flat ground, about 10% of that portion of the amount of fuel injected which corresponds to the evaporated fuel is set as a target purge amount.

Figure 10:
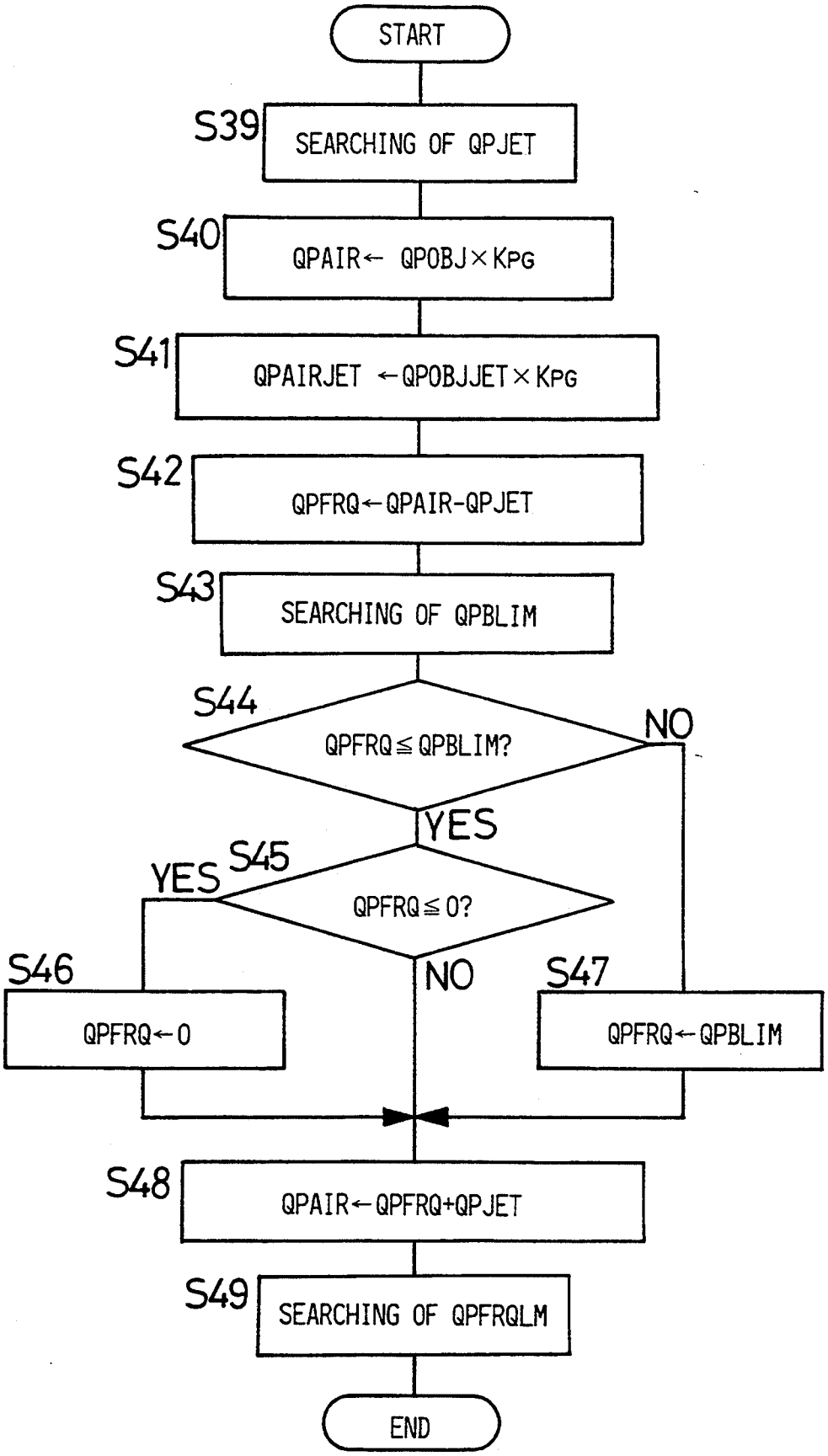
FIG. 10 is a flow chart illustrating a subroutine for calculating an executed purge amount.

FIG. 10 shows a subroutine for carrying out the calculation (the fourth step S4) of a purge amount QPAIR executed in the main routine shown in FIG. 2. At a 39th step S39 in this subroutine, a purge flow rate QPJET permitted by the jet orifice 17 when the on/off control valve 16 is opened, is searched from a map shown in FIG. 11. More specifically, a map with the executable purge flow rate QPJET determined therein in accordance with the intake pressure $P_{BG}$ detected in terms of the gauge pressure has been previously prepared, and the purge flow rate QPJET is searched from this map.

At a next 40th step S4O, an executed total purge amount QPAIR is calculated according to the following expression:

$$QPAIR = QPOBJ \times K_{PG}$$

and, at a 41th step S41, the upper limit value QPAIRJET of the purge flow rate by the jet orifice 17 is calculated according to the following expression:

$$QPAIRJET = QPOBJJET \times K_{PG}$$

and further, at a 42th step S42, a purge flow rate QPFPQ permitted by the duty control valve 15 is calculated according to the following expression:

$$QPFPQ = QPAIR - QPJET$$

Figure 12:
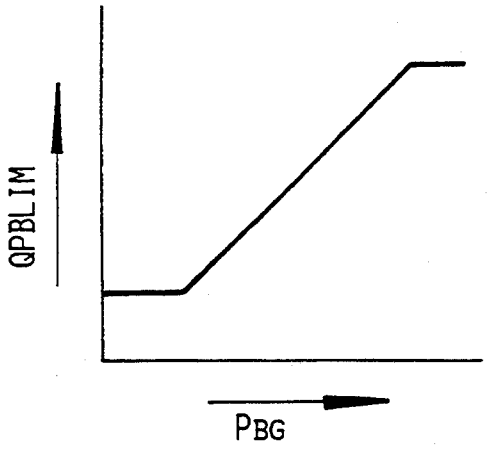
FIG. 12 is a map from which an upper limit value of the purge flow rate is searched.

At a 43th step S43, an upper limit value QPBLIM of the purge flow rate permitted by the duty control valve 15 is searched from a map shown in FIG. 12. More specifically, a map with an upper limit value QPBLIM of the executable purge flow rate determined in accordance with the intake pressure $P_{BG}$ has been previously prepared, and the upper limit value QPBLIM is searched from this map. At a 44th step S44, it is determined whether or not a relation, QPFRG≦QPBLIM is established. If QPFRG≦QPBLIM, it is determined at a 45th step S45 whether or not QPFRG is equal to or less than "0". If QPFRG≦0, QPFRG is set at 0 (i.e., QPFRG=0), progressing continues to a 48th step S48. If it is decided that QPFRG>0, the processing is advanced to the step S48. If it is decided at the 44th step S44 that QPFRG>QPBLIM, a relation, QPFRG=QPBLIM is established, and progressing continues to step S48.

At the step S48, an executed total purge flow rate QPAIR is calculated according to an expression:

$$QPAIR = QPFRQ + QPJET$$

Figure 13:
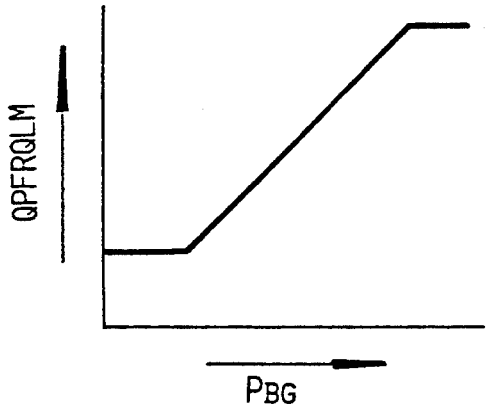
FIG. 13 is a map from which a lower limit value of the purge flow rate is permitted by a duty control valve.

At a 49th step S49, a lower limit value QPFRQLM of the purge flow rate permitted by the duty control valve 15 is searched from a map shown in FIG. 13. More specifically, a map with a lower limit value enabling the purging to be stably executed by the duty control valve being set therein in accordance with the intake pressure $P_{BG}$ has been previously prepared, and the lower limit value QPFRQLM is searched from this map.

In such a subroutine shown in FIG. 10, the executable total purge amount QPAIR, the purge amount QPJET executable by the jet orifice 17 and the purge amount QPFRQ executable by the duty control valve 15 are set in accordance with the current intake pressure $P_{BG}$.

Figure 14:
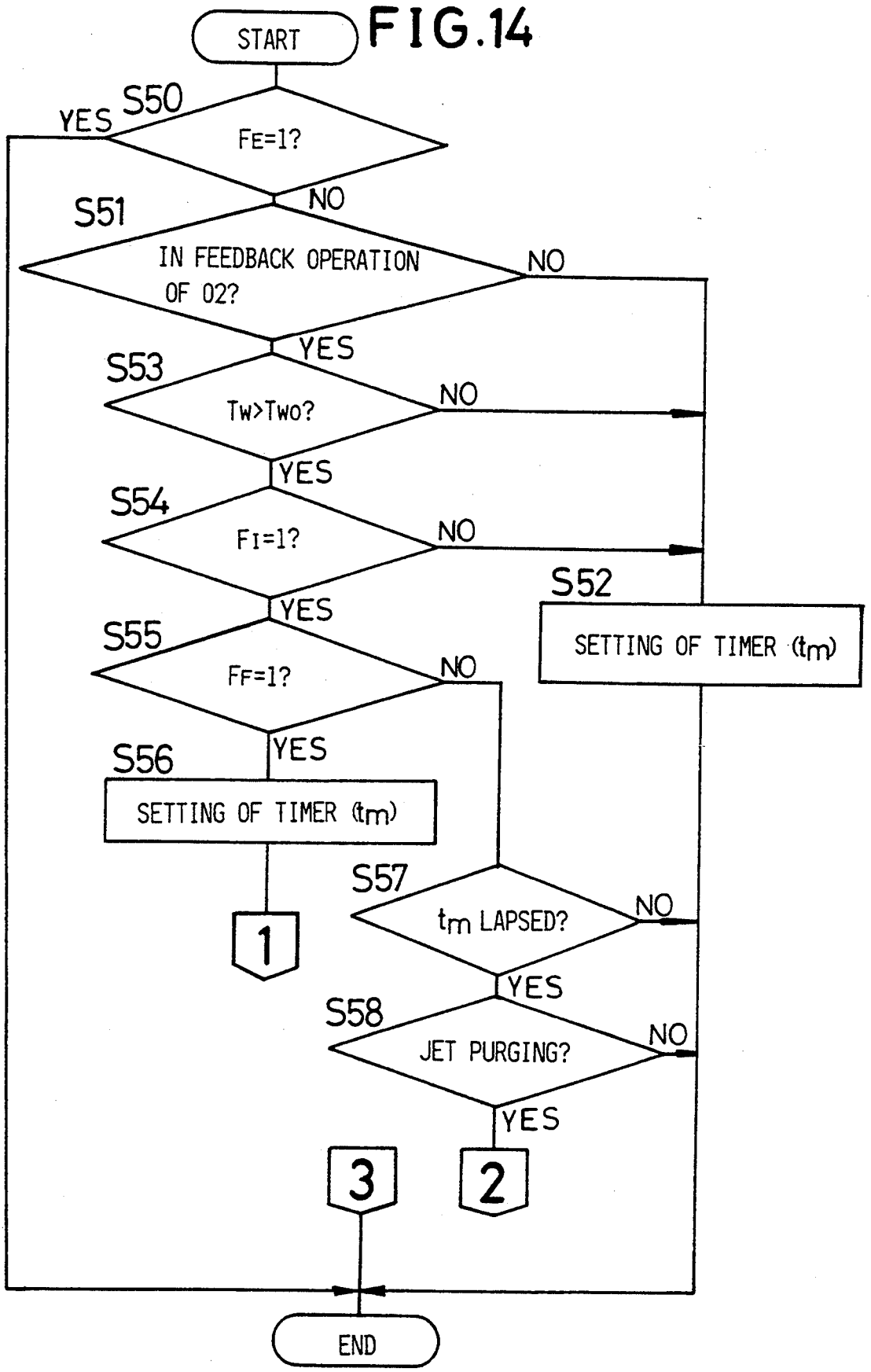
FIG. 14 is a flow chart illustrating a portion of a subroutine for calculating a purge amount integration value.
Figure 15:
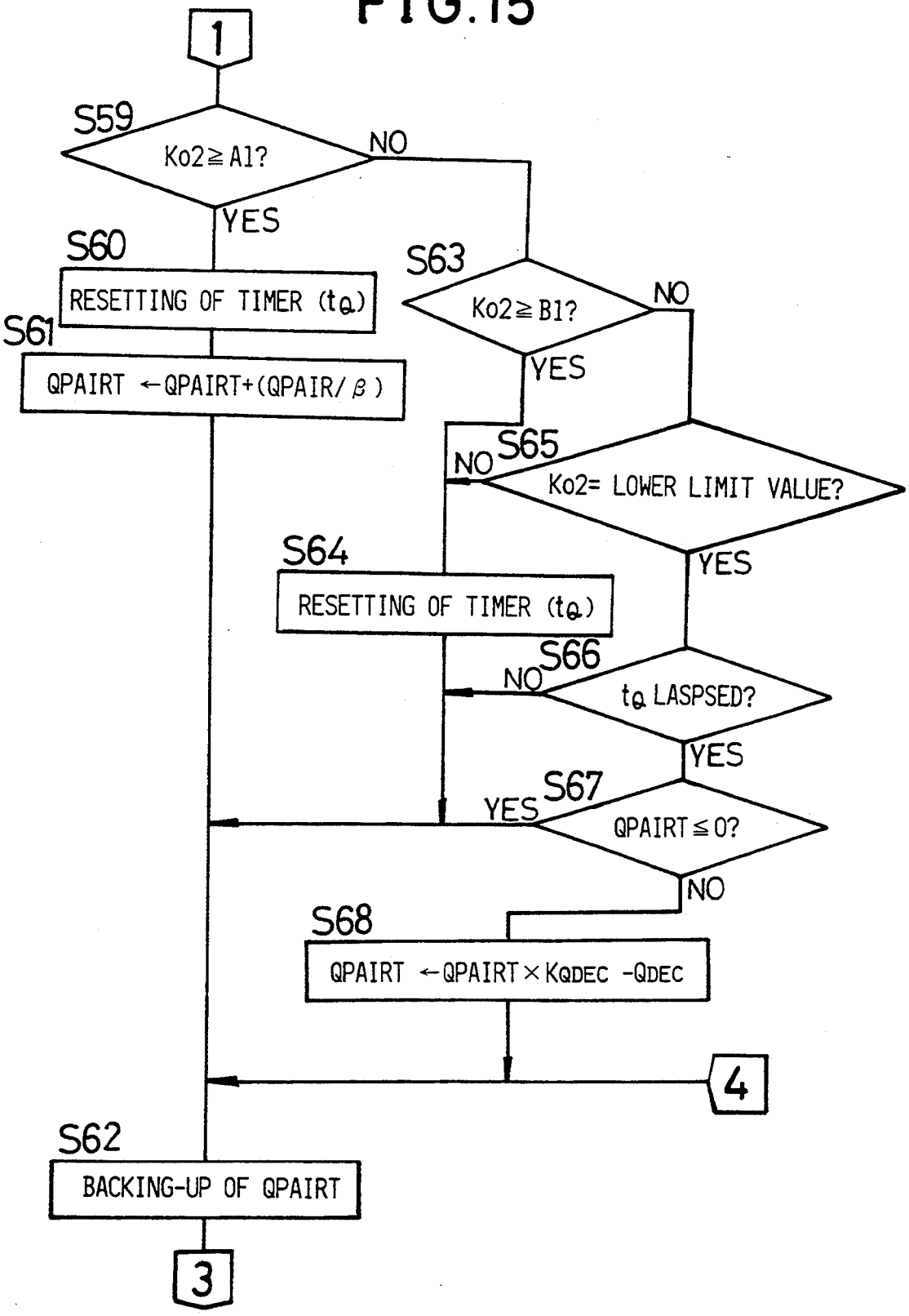
FIG. 15 is a flow chart illustrating a portion of the subroutine for calculating the purge amount integration value.
Figure 16:
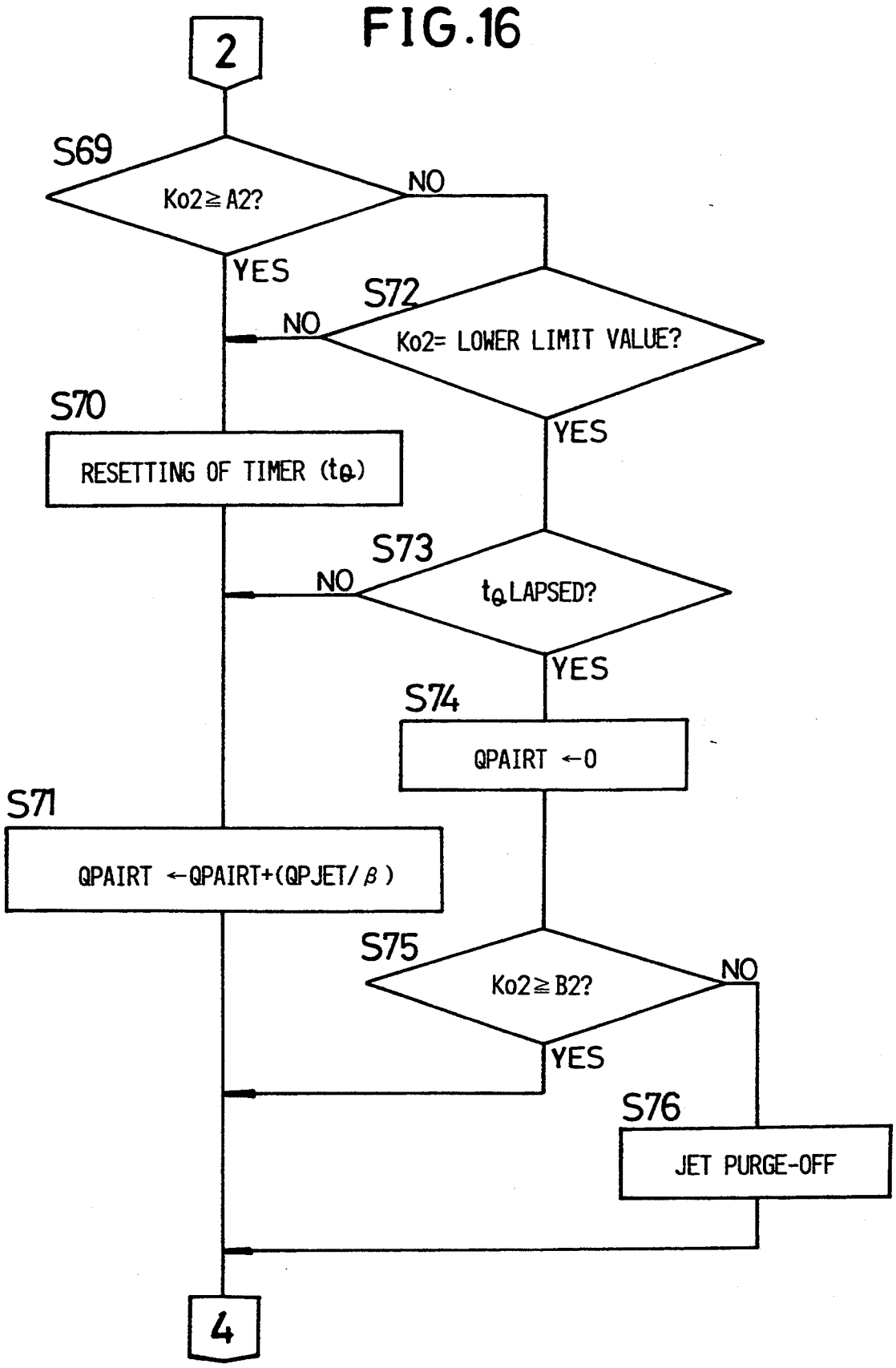
FIG. 16 is a flow chart illustrating a remaining portion of the subroutine for calculating the purge amount integration value.

FIGS. 14, 15 and 16 illustrate a subroutine for carrying out the calculation (the 5th step S5) of the purge integration value QPAIRT in the main routine shown in FIG. 2. First, it is confirmed at a 50th step S50 in FIG. 14 that a flag $F_E$ indicating that a leak-down is being checked is not "1", i.e., the leak-down is not checked. Then, it is determined at a 51th step S51 whether or not a feed-back control according to the concentration of oxygen $O_2$ in the fuel injected by the fuel injection valve 4 is being carried out. In other words, the electronic control unit U controls the amount of fuel injected by the fuel injection valve 4 by an open loop control during starting of the internal combustion engine E, but when a basic mode is selected after the starting, a fuel injection time $T_{OUTN}$ is determined by use of an air-fuel ratio correcting factor $K_{O2}$ corresponding to the concentration of oxygen $O_2$. When the feed-back control is not carried out, the processing is advanced to a 52th step S52, where a timer for counting a given time $t_m$ (e.g., 1 second) is set. During execution of the feed-back control, when it has been confirmed at the 53th and 54th step S53 and S54 that the cooling water temperature $T_W$ exceeds a predetermined value $T_{WO}$ and that a flag $F_I$ is equal to "1", i.e., that the determination of the region shown in FIG. 4 has been completed, respectively, the processing is advanced to a 55th step S55. If the cooling water temperature $T_W$ is equal to or less than the predetermined value $T_{WO}$, or the flag $F_I$ is equal to "0", the processing is advanced to the step S52.

At step S55, it is judged whether or not the flag $F_F$ is equal to "1", i.e., whether or not the purging is being carried out by the duty control valve 15. If it is decided that $F_F=1$, the processing is advanced to a 56th step S56, where the timer for counting the given time $t_m$ is set, and progressing continues to a 59th step S59 shown in FIG. 15. On the other hand, if it is decided that $F_F=0$, it is confirmed at a 57th step S57 whether or not the given time $t_m$ has lapsed. If it is decided that the given time $t_m$ has lapsed, it is confirmed at a 58th step S58 whether or not the on/off control valve 16 has been opened, i.e., whether or not the purging is being carried out by the jet orifice 17. If it is decided that the purging is being carried out, the processing is advanced to a 69 step S69 shown in FIG. 16.

At the step S59 shown in FIG. 13, it is determined whether or not the air-fuel ratio correcting factor $K_{O2}$ is equal to or more than a preset value A1 (e.g., 0.9). If $K_{O2} \geqq A1$, a timer for counting a preset time $t_Q$ (e.g., 1 second) is set at a 60th step S60. At a next 61th step S61, a purge amount integration value QPAIRT is calculated according to the following expression:

$$QPAIRT = QPAIRT + (QPAIR/\beta)$$

wherein $\beta$ is a given value determined in consideration of a time required during one control cycle, and (QPAIR/$\beta$) represents a purge amount increased during one control cycle. At a next 62th step S62, the obtained purge amount integration value QPAIRT is backed up, i.e., stored.

If it is decided at the step S59 that $K_{O2} < A1$, it is determined at a 63th step S63 whether or not the air-fuel ratio correcting factor $K_{O2}$ is equal to or more than a preset value B1 (e.g., 0.8). If $K_{O2} \geqq B1$, the timer ($t_Q$) is reset at a 64th step S64, and progressing continues to the step S62. On the other hand, if it is decided that KO- $_2$<B1, the processing is advanced to a 65th step S65, where it is determined whether or not the air-fuel ratio correcting factor $K_{O2}$ is equal to a lower limit value (e.g., 0.7). If $K_{O2}\neq$the lower limit value, the processing is advanced to the step S64. On the other hand, if $K_{O2}$=the lower limit value, it is determined at a 66th step S66 whether or not the preset time $t_Q$ has lapsed. If it is decided that the preset time $t_Q$ is not lapsed, the processing is advanced to step S66. On the other hand, if it is decided that the preset time $t_Q$ has lapsed, the processing is advanced to a 67th step S67.

At the step S67, it is determined whether or not the purge amount integration value QPAIRT is equal to or less than "0". If it is decided that QPAIRT≦0, the processing is advanced to the step S62. On the other hand, if it is decided that QPAIRT>0, the processing is advanced to a 68th step S68, where a purge amount integration value QPAIRT is calculated according to the following expression:

$$QPAIRT=QPAIRT\times K_{QDEC}-Q_{DEC}$$

wherein each of $K_{QDEC}$ and $Q_{DEC}$ is a given value, and then, the processing is advanced to step S62.

At a 69th step shown in FIG. 16, it is determined whether or not the air-fuel ratio correcting factor $K_{O2}$ is equal to or more than a preset value A2 (e.g., 0.9). If it is decided that $K_{O2}\geqq$A2, the timer for counting the preset time $t_Q$ is reset at a 70th step S70. At a next 71th step S71, a purge amount integration value QPAIRT is calculated according to the following expression:

$$QPAIRT=QPAIRT+(QPJET/\beta)$$

and then, the processing is advanced to step S62 (see FIG. 15). If it is decided at step B69 that $K_{O2}$<A2, it is judged at a 72th step S72 whether or not the air-fuel ratio correcting factor $K_{O2}$ is equal to the lower limit value. If it is decided that the air-fuel ratio correcting factor $K_{O2}$ is not equal to the lower limit value, the processing is advanced to step S70. On the other hand, if it is decided that the air-fuel ratio correcting factor $K_{O2}$ is equal to the lower limit value, the processing is advanced to a 73th step S73. If it is decided at step S73 that the preset time $t_Q$ is not lapsed, the processing is advanced to step S71. If it is decided that the preset time $t_Q$ has been lapsed, the purge amount integration value QPAIRT is set at "0" at a 74th step S74 and then, it is determined at a 75th step S75 whether or not the air-fuel ratio correcting factor $K_{O2}$ is less than a given value B2 which is set at an actually impossible low value. If it is decided that $K_{O2}\geqq$B2, the processing is advanced to step S62. On the other hand, if it is decided that $K_{O2}$<B2, the purging permitted by the jet orifice 17 is stopped at a 76th step S76 and, progressing continues to step S62.

With such a subroutine shown in FIGS. 14, 15 and 16, when $K_{O2}\geqq$A1 during execution of the purging by the duty control valve 15, the integration of the purge amount is continued. When A1>$K_{O2}\geqq$B1, as well as when the duration of the condition in which $K_{O2}$ is equal to the lower limit value is less than the preset time $t_Q$, the integration of the purge amount is stopped, and the last purge integration value QPAIRT is stored. Further, when the duration of the condition in which $K_{O2}$ is equal to the lower limit value is equal to or more than the preset time $t_Q$, the integration value is gradually reduced by a predetermined value at every cycle. When $K_{O2}\geqq$A2 during execution of the purging only by the jet orifice 17, as well as when the duration of the condition in which $K_{O2}$ is equal to the lower limit value becomes equal to or more than the preset time $t_Q$, the integration value is set at "0". Moreover, when $K_{O2}$ becomes less than B2 (i.e., $K_{O2}$<B2), the purging by the jet orifice 17 is stopped, i.e., the on/off control valve 16 is closed.

Figure 17:
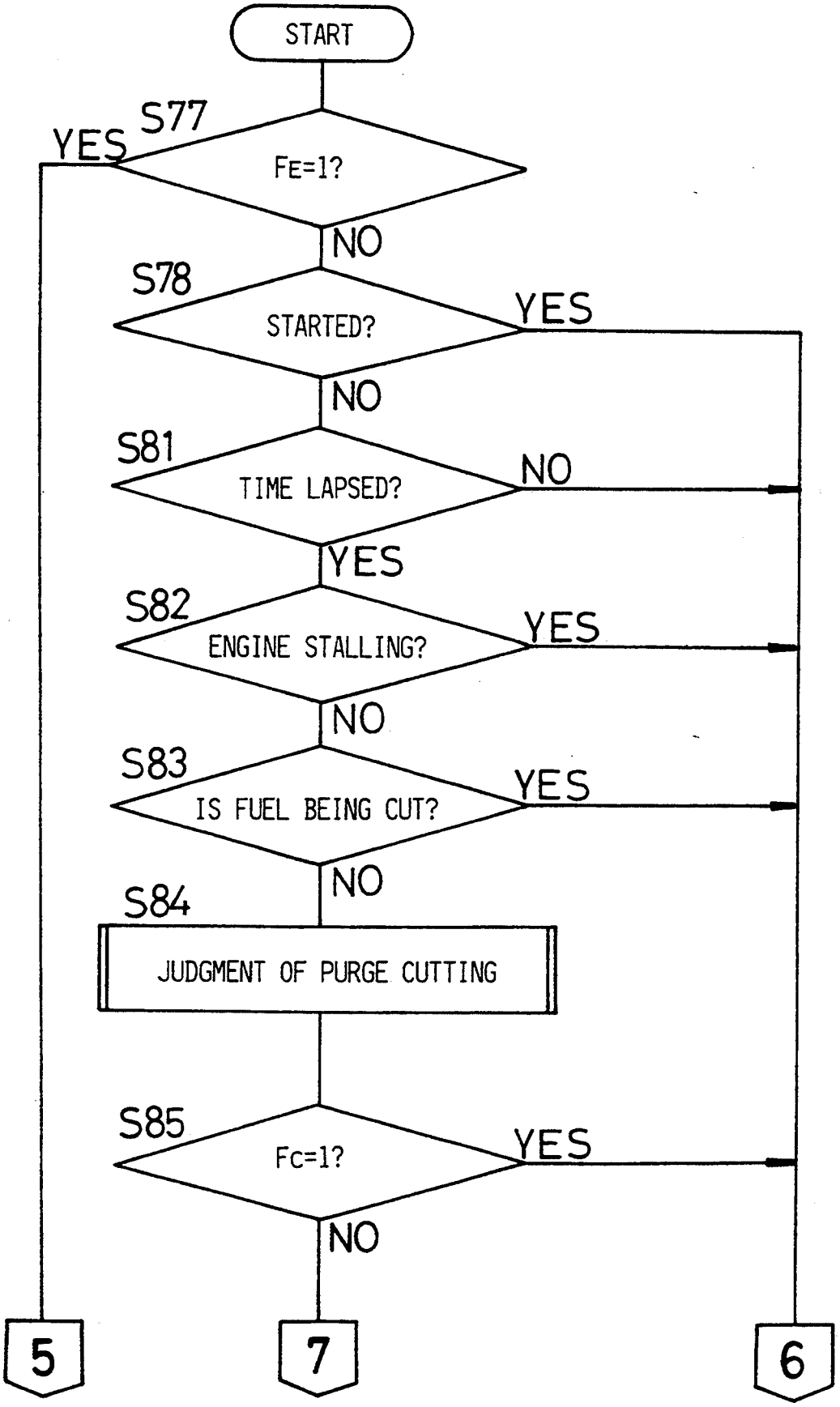
FIG. 17 is a flow chart illustrating a portion of a subroutine for determining a purge control mode.
Figure 18:
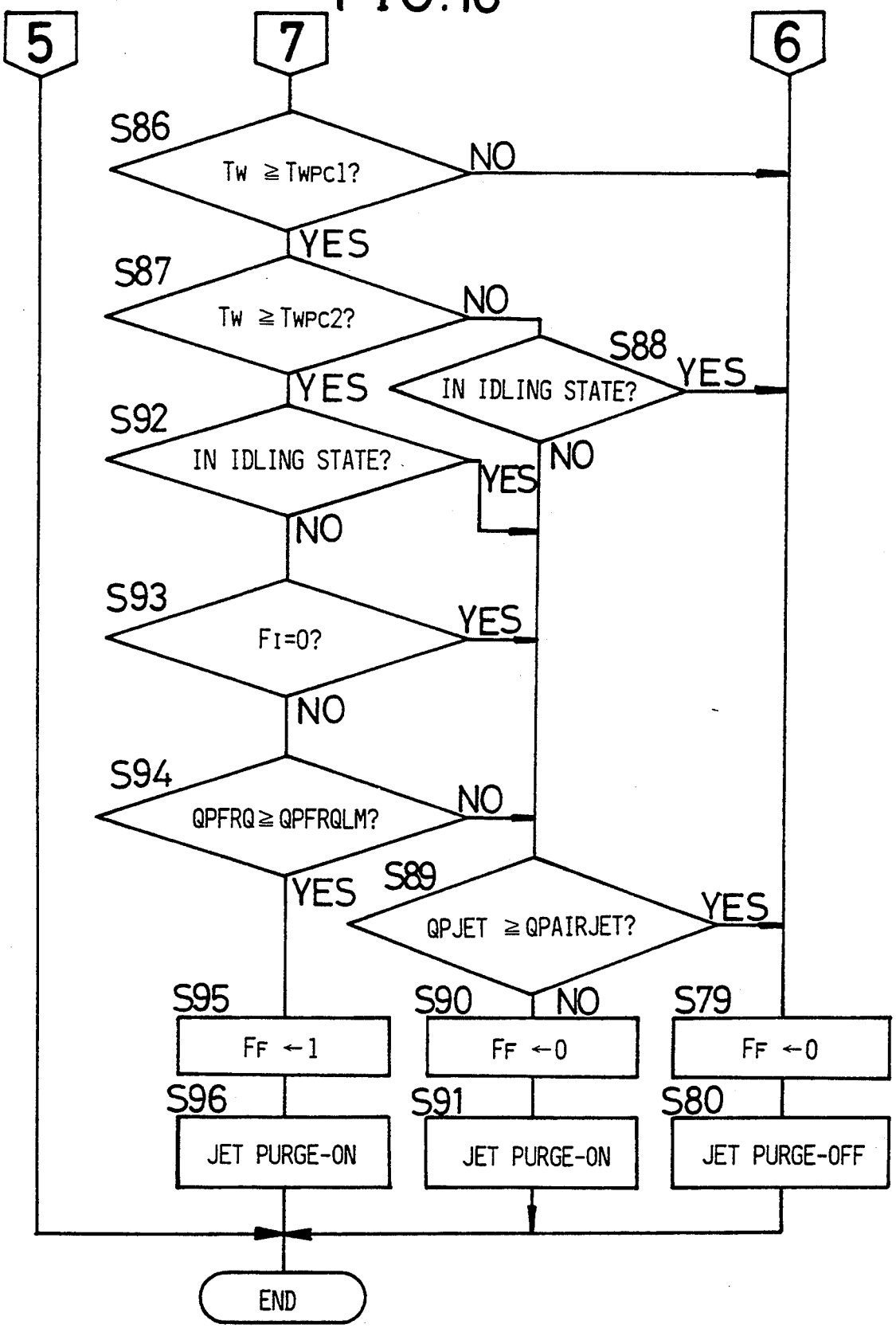
FIG. 18 is a flow chart illustrating a remaining portion of the subroutine for determining the purge control mode.

FIGS. 17 and 18 shows a subroutine for carrying out the determination (step S6) of the purge control mode in the main routine shown in FIG. 2. When $F_E$=0 at a 77th step S77 in this subroutine, i.e., when leak-down is not being checked, it is determined at steps S78, S81, S82 and S83 whether or not the engine E is at a start time, whether or not a predetermined time is not lapsed after the start of the engine E, whether or not the engine is stalling, and whether or not the injection of the fuel from the fuel injection valve 4 has been stopped (i.e., the fuel has been cut), respectively. If the determination is YES at any one of the steps S78, S81, S82 and S83, the processing is advanced to a 79th step S79 shown in FIG. 18, where the flag $F_F$ is set at "0" and then, the purging by the jet orifice 17 is stopped at a 80th step S80.

If it is confirmed at the steps S78, S81, S82 and S83 that the engine E is not at the start time, that the predetermined time has lapsed after the start of the engine E, that the engine is not stalling, and that the injection of the fuel from the fuel injection valve 4 is not stopped (i.e., the fuel is not cut), respectively, the processing is advanced to an 84th step S84.

At the step S84, the determination of the purge cutting is carried out according to a subroutine shown in FIG. 19 which will be described hereinafter. At a next 85th step S85, it is determined whether a flag $F_C$ indicating whether or not the purge cutting should be carried out is equal to "1" or not on the basis of the result of the determination at step S84. $F_C$=1 indicates that the purge cutting should be carried out. If it is decided that $F_C$=1, the processing is advanced to a 79th step S79.

If it is decided at an 85th step S85 that $F_C$=0, the processing is advanced to an 86th step S86 shown in FIG. 18, where it is determined whether or not the cooling water temperature $T_W$ is equal to or more than a preset given temperature $T_{WPC1}$ (e.g., 50° C.). If $T_W\geqq T_{WPC1}$, the processing is advanced to an 87th step S87, and if $T_W\geqq T_{WPC1}$, the processing is advanced to step S79. At the step S87, it is determined whether or not the cooling water temperature $T_W$ is equal to or more than a preset given temperature $T_{WPC2}$ (e.g., 80° C.). If $T_W\geqq T_{WPC2}$, the processing is advanced to a 92th step S92, and if $T_W<T_{WPC2}$, the processing is advanced to an 88th step S88. At this step S88, it is determined whether or not the engine E is in an idling state. If the engine E is in the idling state, the processing is advanced to step S79, and if not, the processing is advanced to an 89th step S89.

Figure 11:
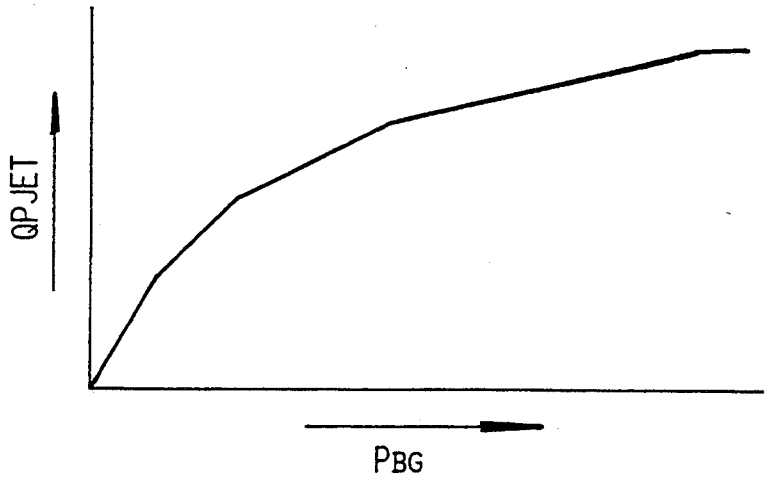
FIG. 11 is a map from which a purge flow rate from a jet orifice is searched.

At the step S89, it is determined whether or not the purge amount QPAIRJET permitted by the jet orifice 17 is equal to or less than the QPJET obtained from FIG. 11. If it is decided that QPJET≧QPAIRJET, the processing is advanced to step S79. If QPJET<QPAIRJET, the processing is advanced to a 90th step S90, where a relation $F_F$=0 is established, and then, the purging by the jet orifice 17 is carried out at a 91th step S91.

At step S92, it is determined whether or not the engine E is in the idling state. If the engine E is in the idling state, the processing is advanced to step S89, and if not, the processing is advanced to a 93th step S93. At this step S93, it is determined whether or not $F_I=0$, i.e., whether or not the determination of the initialization region is not completed. When $F_I=0$, the processing is advanced to step S89. On the other hand, when $F_I=1$, the processing is advanced to a 94th step S94.

At step S94, it is determined whether or not the purge amount QPFRQ permitted by the duty control valve 15 is equal to or more than the lower limit value QPFRQLM determined in FIG. 13. If it is decided that QPFRQ≧QPFRQLM, the processing is advanced to a 95th step S95, where a relation, $F_F=1$ is established, and then, the purging by the jet orifice 17 is carried out at a 96th step S96. On the other hand, if it is decided at step S94 that QPFRQ<QPFRQLM, the processing is advanced to step S89.

Figure 19:
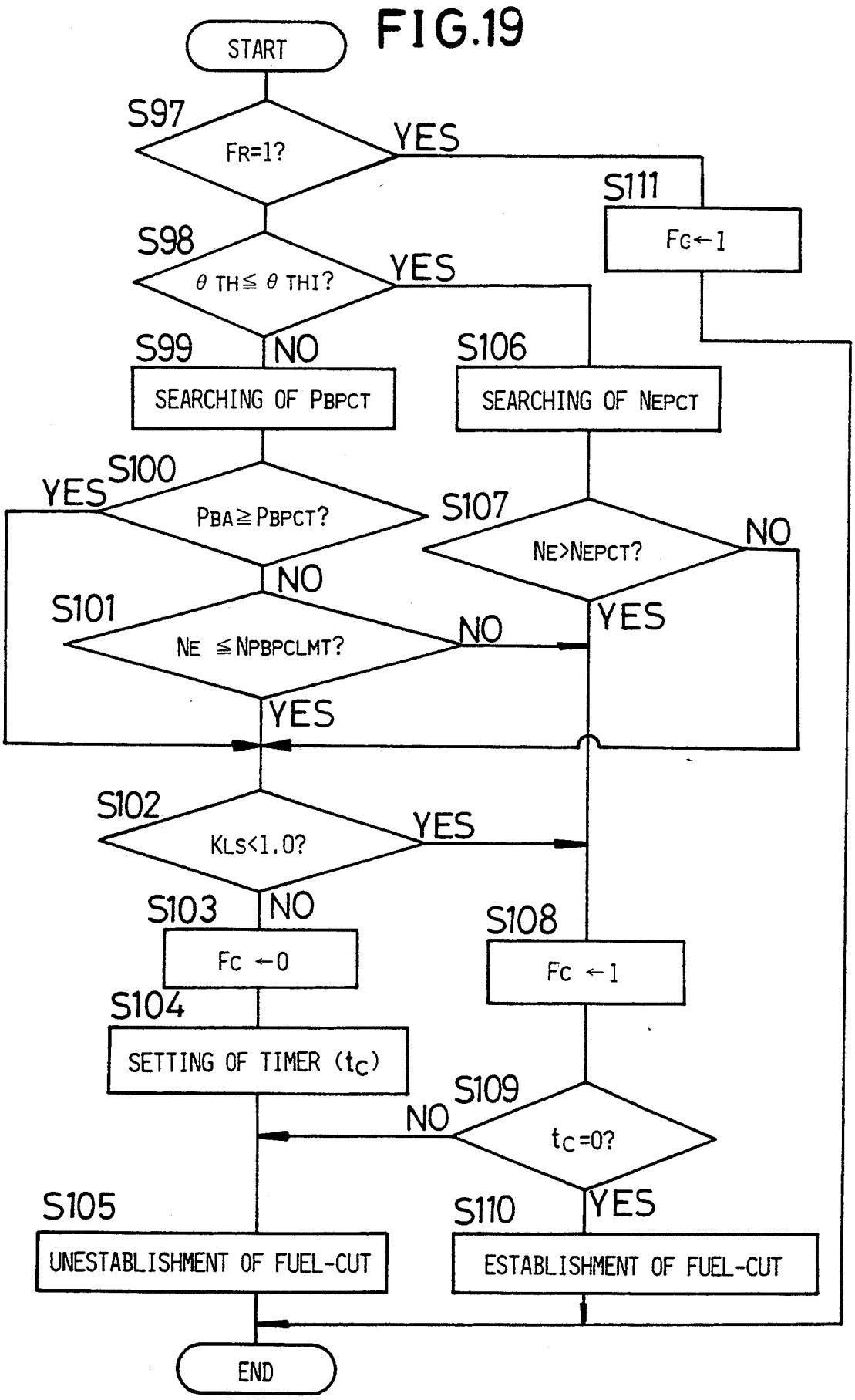
FIG. 19 is a flow chart illustrating a subroutine for determining the cutting of purging.

A subroutine for carrying out step S84 shown in FIG. 17 is as shown in FIG. 19. At a 97th step S97 shown in FIG. 19, it is determined whether or not a flag $F_R$ is equal to "1". This flag $F_R$ indicates whether or not the checking of the variation in the air-fuel ratio correcting value $K_{O2}$ is being carried out by cutting the purging of the evaporated fuel in order to confirm whether or not the control of the air-fuel ratio on the side of the fuel injection valve 4 is normal. When the checking is being carried out, $F_R=1$. When $F_R=0$, it is determined at a 98th step S98 whether or not the throttle opening degree $\Theta_{TH}$ is equal to or less than an idle opening degree $\Theta_{THI}$. If $\Theta_{TH}>\Theta_{THI}$, the processing is advanced to a 99th step S99.

Figure 20:
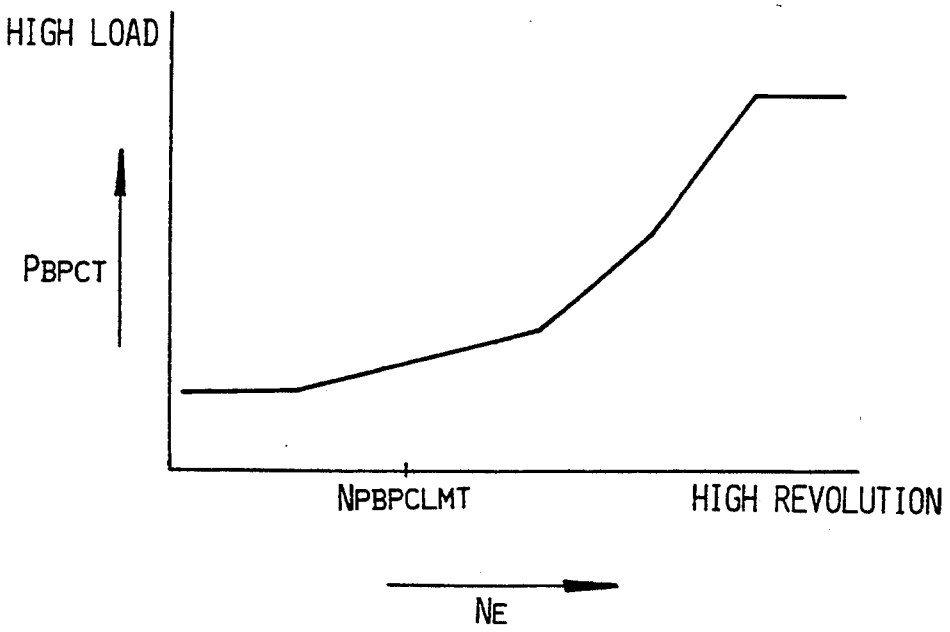
FIG. 20 is a map from which a preset intake pressure, corresponding to the number of revolutions of the engine, is searched.

At this step S99, a preset pressure $P_{BPCT}$ corresponding to the number $N_E$ of revolutions of the engine E is searched from a map shown in FIG. 20, and at a next 100th step S100, it is determined whether or not an intake pressure $P_{BA}$ determined in terms of an absolute pressure is equal to or more than a preset pressure $P_{BPCT}$. When $P_{BA}<P_{BPCT}$, the processing is advanced to a 101th step S101. On the other hand, when $P_{BA}\geqq P_{BPCT}$, the processing is advanced to a 102th step S102 to bypass step S101.

At step S101, it is determined whether or not the number $N_E$ of revolutions of the engine E is equal to or less than a preset revolution number $N_{PBPCLMT}$ shown in FIG. 20. When $N_E\leqq N_{PBPCLMT}$, the processing is advanced to step S102, where it is determined whether or not a replacement value $K_{LS}$ of the air-fuel ratio correcting factor $K_{O2}$ during reduction of the speed of the vehicle is less than 1.0. When $K_{LS}\geqq 1.0$, the flag $F_C$ is set at "0" at a 103th step S103. Then, a timer for counting a preset time (e.g., 1 second) is set at a 104th step S104 and then, the stoppage of the injection of the fuel from the fuel injection valve 4 (the cutting of the fuel) is unestablished at a 105th step S105.

Figure 21:
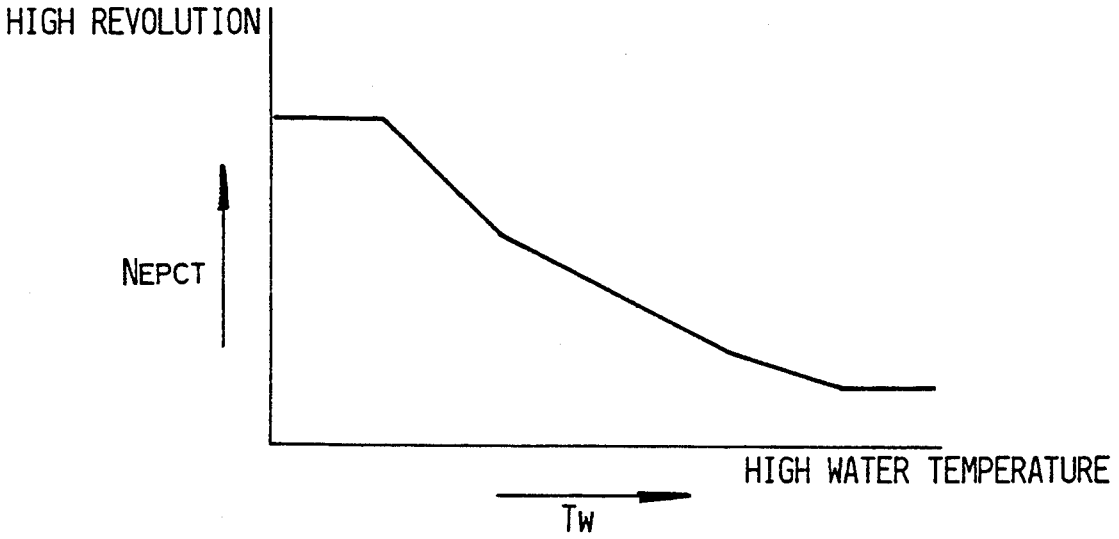
FIG. 21 is a map from which a preset revolution number, corresponding to a cooling water temperature, is searched.

If it is decided at step S98 that $\Theta_{TH}\leqq\Theta_{THI}$, the processing is advanced from step S98 to a 106th step S106, where a preset revolution number $N_{EPCT}$ set in accordance with the cooling water temperature $T_W$ as shown in FIG. 21 is searched. Then, at a 107th step S107, it is determined whether or not a relation, $N_E>N_{EPCT}$ is established. If it is decided that $N_E\leqq N_{EPCT}$, the processing is advanced to step S102.

When it is decided at step S107 that $N_E>N_{EPCT}$, when it is determined at step S101 that $N_E>N_{PBPCLMT}$, as well as when it is decided at step S102 that $K_{LS}<1.0$, the processing is advanced to a 108th step S108 where the flag $F_C$ is set at "1". At a next 109th step S109, it is determined whether or not a preset time $t_c$ has lapsed. If it is decided that the preset time $t_c$ has lapsed, the injection of the fuel from the fuel injection valve 4 is stopped (the fuel is cut) at a 110th step S110.

If it is decided at the step S97 that $F_R=1$, $F_C$ is set at "1" at a 111th step S111.

With such subroutines as shown in FIGS. 17 to 19, the purging by the duty control valve 15 and the jet orifice 17 is stopped if even one of the following conditions is established:

- the predetermined time is not lapsed after the start of the engine E;
- the engine is stalling;
- the injection of the fuel from the fuel injection valve 4 has been stopped (the fuel has been cut);
- the flag $F_C$ is equal to "1";
- the cooling water temperature $T_W$ is a lower level, for example, less than 50° C.;
- the cooling water temperature $T_W$ is, for example, equal to or more than 50° C., but for example, less than 80° C. and the engine is in the idling state; and
- the purge amount value QPAIRJET executed by the jet orifice 17 is less than the executable purge amount QPJET determined by the intake pressure $P_{BG}$. In addition, the purging by the duty control valve 15 and the jet orifice 17 is carried out when the relation $F_I=1$ is established and the purge amount QPFRQ permitted by the duty control valve 15 is equal to or more than the lower limit value QPFRQLM determined by the intake pressure $P_{BG}$ in a condition in which the cooling water temperature $T_W$ is, for example, equal to or more than 80° C. and the engine E is not in the idling state. Further, the purging by the jet orifice 17 is carried out, but the purging by the duty control valve 15 is not carried out if the purge amount QPAIRJET executed by the jet orifice 17 is equal to or more than the executable purge amount QPJET determined by the intake pressure $P_{BG}$ when the cooling water temperature $T_W$ is, for example, equal to or more than 50° C. but for example, less than 80° C. and the engine E is not in the idling state, or when the relation $F_I=0$ is established and the purge amount QPFRQ permitted by the duty control valve 15 is less than the lower limit value QPFRQLM even if the engine E is not in the idling state in a condition in which the cooling water temperature $T_W$ is, for example, equal to or more than 80° C.

Moreover, when $N_E>N_{PBPCLMT}$ in a condition in which the relation $P_{BA}<P_{BPCT}$ is established; when $N_E>N_{BPCT}$ in a condition in which the relation $\Theta_{TH}<\Theta_{THI}$ is established, as well as when the relation $P_{BA}\geqq P_{BPCT}$ or $N_E\leqq N_{BPCT}$ is established, the flag $F_C$ is set at "1", and the cutting of the purging is carried out, and when a condition in which the relation $F_C=1$ is established is continued for the preset time $t_c$ from the cutting of the purging, the cutting of the fuel is carried out.

Figure 22:
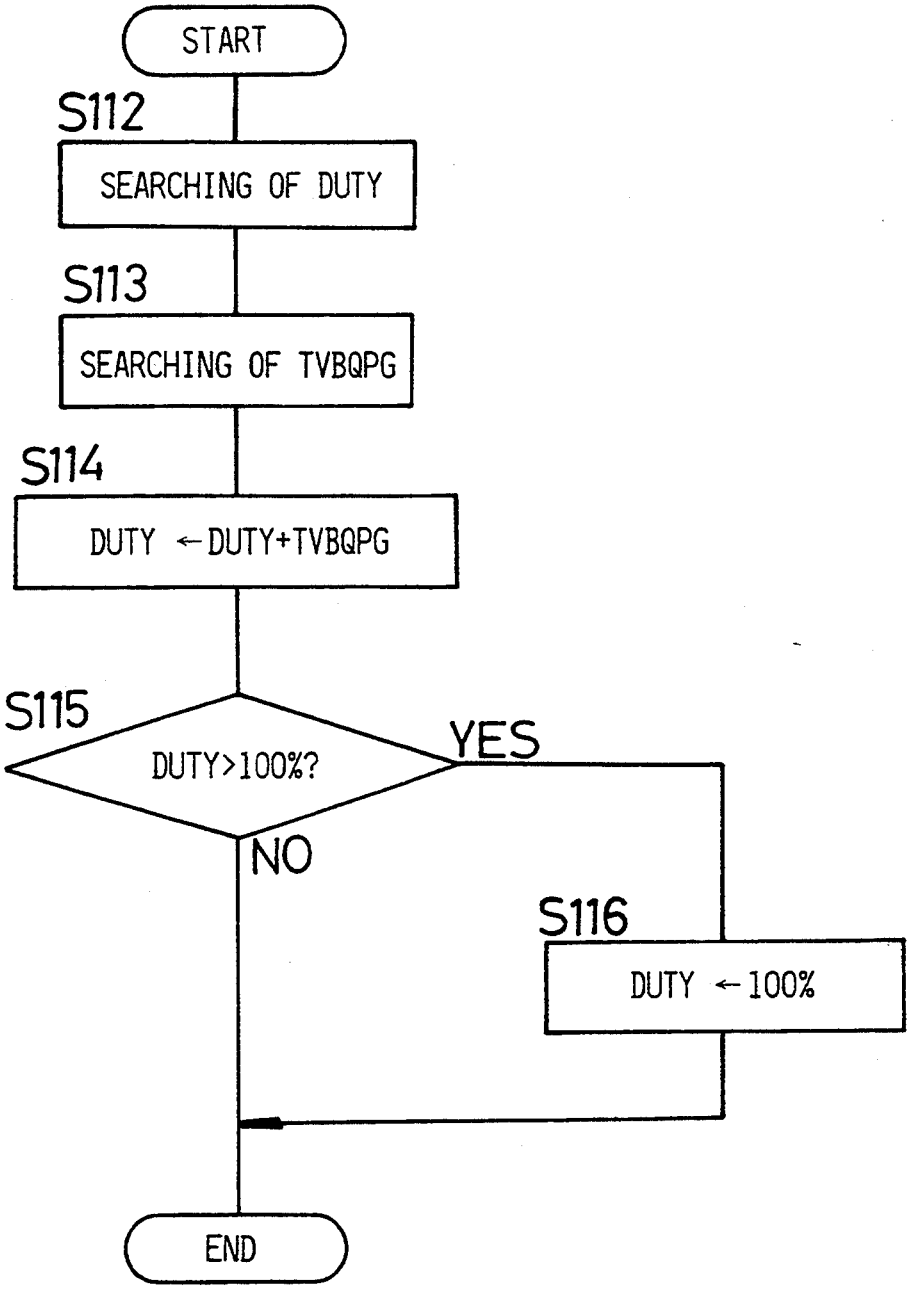
FIG. 22 is a flow chart illustrating a subroutine for calculating a duty ratio.

FIG. 22 illustrates a subroutine for carrying out the calculation of the duty ratio DUTY in the main routine shown in FIG. 2. At a 112th step S112 shown in FIG. 22, the duty ratio DUTY of the duty control valve 15 is searched in accordance with the intake pressures $P_{BG}1$–$P_{BG}6$. At a next 113th step S113, a correcting factor TVBQPG based on the battery voltage $V_B$ is searched from a map shown in FIG. 24. An influence due to a variation in battery voltage $V_B$ is compensated for by the correction by addition of the correcting factor TVBQPG to the duty ratio DUTY at a 114th step S114. If it is decided at step S115 that the duty ratio DUTY exceeds 100%, the duty ratio DUTY is set at 100% at a 116th step S116.

It should be noted that the electronic control unit U determines the feed-back control region and the open-loop control region corresponding to the concentration of oxygen in the exhaust gas, and calculates the time $T_{OUT}$ of injection of the fuel from the fuel injection valve 4 in accordance with the operational condition of the engine E according to the following expression:

$$T_{OUT}=T_{IN}\times K_{O2}\times K_1+K_2$$

wherein $T_{IN}$ is a basic time determined in accordance with the number $N_E$ of revolution of the engine E and the intake pressure $P_{BA}$; $K_1$ and $K_2$ are a correcting factor and a correcting variable determined in accordance with the indication representing the operational condition of the engine E such as the cooling water temperature $T_W$, the opening degree of the throttle valve 6 and the like, and are set so as to provide optimal characteristics such as the fuel consumption and acceleration characteristics corresponding to the operational condition of the engine E. The amount $T_{OUTN}$ of fuel injected from the fuel injection valve 4 is obtained based on the fuel injection time $T_{OUT}$ and the fuel supply pressure.

Figures 23, 24:
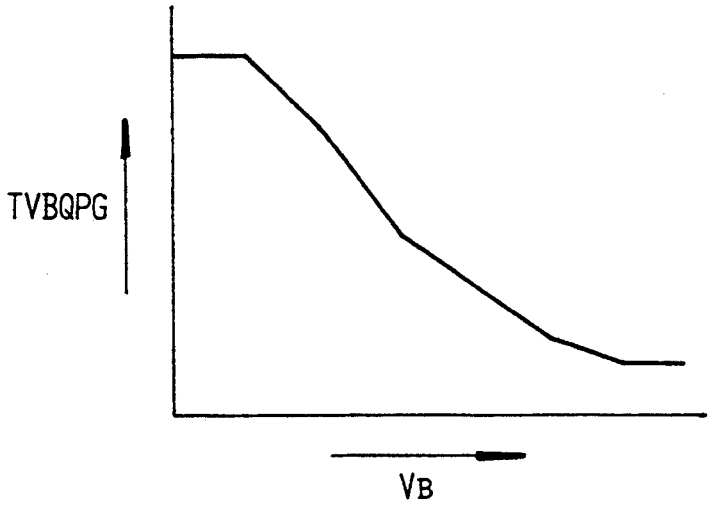
FIG. 23 is a map from which a duty ratio is searched.
FIG. 24 is a map from which a voltage correcting factor is searched.
Figure 25:
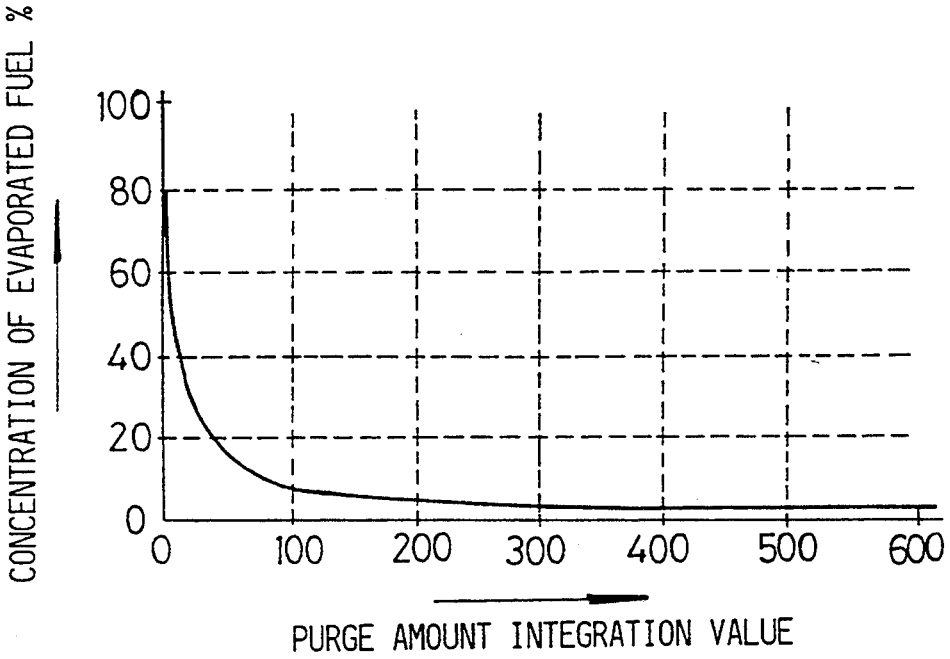
FIG. 25 is a graph illustrating the relationship between the purge amount integration value and the concentration of the evaporated fuel.

The operation of this embodiment will be described below. As the purge amount integration value QPAIRT is increased, the concentration of the evaporated fuel stored in the canister C is gradually decreased, as shown in FIG. 24. Therefore, the concentration of the evaporated fuel purged into the intake passage 5 is also decreased. However, as described at steps S2, S3 and S4 in the main routine shown in FIG. 2, the purge amount QPAIR is determined by multiplication of the target purge amount QPOBJ by the purge correcting factor $K_{PG}$ which is smaller as the purge amount integration value QPAIRT is smaller. In other words, the smaller the purge amount integration value QPAIRT, the more the purge amount QPAIR is decreased. Therefore, it is possible to purge a substantially constant amount of the evaporated fuel into the intake passage 5 in correspondence to the concentration of the evaporated fuel to avoid an adverse influence exerted on the control of the air-fuel ratio, thereby providing an improvement in the nature of the exhaust gas.

Moreover, when it is decided, on the basis of the intake gas temperature $T_A$ and the cooling water temperature $T_W$, that upon the starting of the engine E, a temperature is in a condition in which it can be decided that such starting of the engine is a restarting after a lapse of a relatively short time from the stoppage of the operation of the engine E, i.e., that the engine E is in a region in which the back-up value shown in FIG. 4 is used, the integration of the purge amount is started by using, as an initial value, the final value of the purge amount integration values QPAIRT which have been integrated till the stoppage of the engine E on the assumption that the engine E has been restarted for a short time. Therefore, in a condition such as when the engine E has been restarted after a short time, it is assumed that the amount of evaporated fuel stored in the canister C is little varied from the time when the engine E has been stopped. On the basis of this assumption, the purge amount integration value QPAIRT can be integrated as a value substantially corresponding to the amount of evaporated fuel actually stored in the canister C, thereby enabling a proper control of the air-fuel ratio.

When the air-fuel ratio correcting value $K_{O2}$ is less than the predetermined value A1 during purging performed by the duty control valve 15, the integration of the purge amount is prohibited, and the purge amount is determined in accordance with the purge amount integration value QPAIRT immediately before the prohibition. Therefore, when the air-fuel ratio is relatively high, the integration of the purge amount can be prohibited to prevent the increase in error between the amount of evaporated fuel actually stored in the canister C and the amount evaporated fuel evaluated on the basis of the purge amount integration value QPAIRT, thereby preventing an adverse influence from being exerted on the control of the air-fuel ratio on the basis of the purge amount integration value QPAIRT.

Furthermore, when the duration of a condition in which the air-fuel ratio correcting factor $K_{O2}$ is of the lower limit value becomes equal to or more than the preset time $t_Q$, the purge amount integration value QPAIRT is reduced by the predetermined value at every cycle. Therefore, it is possible to correct the error between the amount of evaporated fuel actually stored in the canister C and the amount of evaporated fuel evaluated on the basis of the purge amount integration value QPAIRT, thereby further reducing the adverse influence exerted on the control of the air-fuel ratio in the purge control.

Further, when $N_E>N_{PBPCLMT}$ in a condition in which $P_{BA}<P_{BPCT}$ is established during reduction of the speed of the engine E or the like; when $N_E>N_{BPCT}$ is established in a condition in which $\Theta_{TH}\leqq\Theta_{THI}$, as well as when $P_{BA}\geqq P_{BPCT}$ or $N_E\leqq N_{PBPCLM}$ is established, the cutting of the purging is carried out correspondingly, and the cutting of the fuel is carried out at the preset time $t_c$ after such cutting of the purging. Therefore, the evaporated fuel remaining in the purge passage 9 downstream from the purge control means 14 cannot be drawn into the engine E during cutting of the fuel, and the adverse influence cannot be exerted to a catalyst in an exhaust system, thereby enabling a sufficient control of the speed reduction.

Although the embodiment of the present invention has been described in detail, it will be understood that the present invention is not limited to the above-described embodiment, and various modifications in design can be made without departing from the scope of the invention defined in the claims.

What is claimed is:

1. An evaporated fuel control system in an internal combustion engine, comprising:

a canister filled with an adsorbent for adsorbing evaporated fuel in a fuel tank;

a purge amount control means provided in a middle of a purge passage connecting an intake passage and the canister;

a fuel supply means; and an electronic control unit for integrating a purge flow rate from a start of purging and for controlling an operation of the purge amount control means so as to reduce the purge amount to a larger extent in response to the integrated purge amount value becoming smaller.

2. An evaporated fuel control system in an internal combustion engine according to claim 1, wherein said electronic control unit sets an initial value for integrating the purge amount in a new operation to a final value of the purge amount integration values integrated during a last operation of the engine, when the engine, during starting thereof, is in such an operational state that the engine is at a predetermined temperature and is being restarted.

3. An evaporated fuel control system in an internal combustion engine according to claim 1 or 2, wherein said electronic control unit controls the operation of the fuel supply means, such that an amount of fuel supplied is increased as an air-fuel ratio correction value corresponding to a concentration of oxygen in exhaust gas is increased, and said electronic control unit prohibits integration of the purge amount and determines the purge amount in accordance with the purge amount integration value obtained immediately before the prohibition, when the air-fuel ratio correction value is less than a predetermined value.

4. An evaporated fuel control system in an internal combustion engine according to claim 3, wherein said electronic control unit reduces the purge integration amount by a predetermined amount at every cycle and determines a purge amount in accordance with the reduced purge amount integration value, when a condition in which the air-fuel ratio correction value is a lower limit value is continued for a predetermined time.

* * * * *